US010910209B2

(12) United States Patent
VanGordon et al.

(10) Patent No.: US 10,910,209 B2
(45) **Date of Patent: *Feb. 2, 2021**

(54) MALDI-TOF MASS SPECTROMETERS WITH DELAY TIME VARIATIONS AND RELATED METHODS

(71) Applicant: bioMérieux, Inc., Durham, NC (US)

(72) Inventors: James VanGordon, Maryland Heights, MO (US); Bradford Clay, Wildwood, MO (US)

(73) Assignee: bioMérieux, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/812,883

(22) Filed: Mar. 9, 2020

(65) Prior Publication Data

US 2020/0350152 A1 Nov. 5, 2020

Related U.S. Application Data

(63) Continuation of application No. 16/058,016, filed on Aug. 8, 2018, now Pat. No. 10,615,023, which is a continuation of application No. 15/362,979, filed on Nov. 29, 2016, now Pat. No. 10,068,760, which is a continuation of application No. 14/837,832, filed on Aug. 27, 2015, now Pat. No. 9,536,726.

(60) Provisional application No. 62/043,533, filed on Aug. 29, 2014.

(51) Int. Cl.

| | |
|---|---|
| ***H01J 49/40*** | (2006.01) |
| ***H01J 49/16*** | (2006.01) |
| ***H01J 49/00*** | (2006.01) |
| ***H01J 49/04*** | (2006.01) |

(52) U.S. Cl.

CPC ..... *H01J 49/40* (2013.01); *H01J 49/0027* (2013.01); *H01J 49/0418* (2013.01); *H01J 49/164* (2013.01); *H01J 49/403* (2013.01)

(58) Field of Classification Search

CPC ..... H01J 49/40; H01J 49/0418; H01J 49/164; H01J 49/403

USPC ..... 250/281, 282, 283, 286, 287, 288

See application file for complete search history.

(56) References Cited

U.S. PATENT DOCUMENTS

| | | | |
|---|---|---|---|
| 5,510,613 | A | 4/1996 | Reilly et al. |
| 5,625,184 | A | 4/1997 | Vestal et al. |
| 5,627,369 | A | 5/1997 | Vestal et al. |
| 5,641,959 | A | 6/1997 | Holle et al. |

(Continued)

FOREIGN PATENT DOCUMENTS

| | | |
|---|---|---|
| WO | 200196000 | 12/2001 |

OTHER PUBLICATIONS

Brown et al. "Mass Resolution Improvement by Incorporation of Pulsed Ion Extraction in a Matrix-Assisted Laser Desorption/Ionization Linear Time-of-Flight Mass Spectrometer" Analytical Chemistry 67( 13): 1998-2003 ( 1995).

(Continued)

*Primary Examiner* — Nicole M Ippolito

(74) *Attorney, Agent, or Firm* — Myers Bigel, P.A.

(57) ABSTRACT

MALDI-TOF MS systems have solid state lasers and successive and varied delay times between ionization and acceleration (e.g. extraction) to change focus masses during a single sample signal acquisition without requiring tuning of the MS by a user. The (successive) different delay times can change by 1 ns to about 500 ns, and can be in a range that is between 1-2500 nanoseconds.

20 Claims, 26 Drawing Sheets

(56) References Cited

U.S. PATENT DOCUMENTS

| | | | | |
|---|---|---|---|---|
| 5,712,479 | A | 1/1998 | Reilly et al. | |
| 5,742,049 | A | 4/1998 | Holle et al. | |
| 5,760,393 | A | 6/1998 | Vestal et al. | |
| 5,777,325 | A | 7/1998 | Weinberger et al. | |
| 5,905,259 | A | 5/1999 | Franzen | |
| 5,969,348 | A | 10/1999 | Franzen | |
| 6,002,127 | A | 12/1999 | Vestal et al. | |
| 6,057,543 | A | 5/2000 | Vestal et al. | |
| 6,130,426 | A | 10/2000 | Laukien et al. | |
| 6,281,493 | B1 | 8/2001 | Vestal et al. | |
| 6,518,568 | B1 | 2/2003 | Kovtoun et al. | |
| 6,541,765 | B1 | 4/2003 | Vestal | |
| 6,552,335 | B1 | 4/2003 | Guo et al. | |
| 6,717,132 | B2 | 4/2004 | Franzen | |
| 6,870,158 | B1 | 3/2005 | Blain | |
| 7,176,454 | B2 | 2/2007 | Hayden et al. | |
| 7,772,552 | B2 | 8/2010 | Gribb et al. | |
| 9,536,726 | B2 * | 1/2017 | VanGordon ..... | H01J 49/0418 |
| 10,068,760 | B2 * | 9/2018 | VanGordon ..... | H01J 49/0027 |
| 10,615,023 | B2 * | 4/2020 | VanGordon ..... | H01J 49/40 |
| 2002/0145110 | A1 | 10/2002 | Holle | |
| 2005/0059013 | A1 | 3/2005 | Chan et al. | |
| 2006/0138316 | A1 | 6/2006 | Seydoux et al. | |
| 2006/0195271 | A1 | 8/2006 | Park | |
| 2012/0298855 | A1 | 11/2012 | Satoh | |
| 2016/0111271 | A1 | 4/2016 | Bohm | |

OTHER PUBLICATIONS

Carvalho et al. "A New Gridless Ion Optics For High Resolution Time-of-Flight Mass Spectrometer" International Journal of Modern Physics B 19(15-17):2621-2626 (2005).

Demirev et al. "Microorganism Identification by Mass Spectrometry and Protein Database Searches" Analytical Chemistry 71 (14):2732-2738 (1999).

Erickson et al. "Mass Dependence of Time-Lag Focusing In Time-Of-Flight Mass Spectrometry—An Analysis" International Journal of Mass Spectrometry and Jon Processes 97:87-106 (1990).

Explorer One, Compact and Lightweight UV NS Lasers, Spectra-Physics, product description, http://www.spectra-physics.com/products/q-switched-lasers/explorer-one, date unknown but before the priority date of the present application, printed from the Internet, 8 pages(Aug. 14, 2014).

Garner et al. "Multi-Center Evaluation of the VITEK MS for the Mass Spectrometric Identification of Anaerobic Bacteria in the Clinical Microbiology Laboratory" UCLA Health Systems, Poster date unknown but believed to be before the priority date of the present application (1 page).

International Preliminary Report on Patentability corresponding to International Patent Application No. PCT/US2015/047203 (12 pages) (dated Mar. 9, 2017).

International Search Report and the Written Opinion of the International Searching Authority corresponding to International Patent Application No. PCT/US2015/047203 (17 pages) (dated Jan. 11, 2016).

Ortec®, Research Applications, Timing, Specifications and Instructions Metek® Advanced Measurement Technology date unknown but believed to be before priority date of the present application (13 pages).

Rychert et al. "Multicenter Evaluation of the Vitek MS Matrix-Assisted Laser Desorption Ionization-Time of Flight Mass Spectrometry System for Identification of Gram-Positive Aerobic Bacteria" J Clin Microbial 51 (7):2225-2231 (2013).

SimuiTOF 300 Tandem, SimuiTOF Systems, product description, http://www.simultof.com/content/simultof-300-tandem, date unknown but believed to be before the priority date of the present application, printed from the internet Aug. 25, 2015 (2 pages).

Vestal "Modern MALDI time-of-flight mass spectrometry" J. Mass Spectrom. 44:303-317 (2009).

Vestal et al. "High performance MALDI-TOF mass spectrometry for proteomics" International Journal of Mass Spectrometry 268(2):83-92 (2007) (Abstract Only).

Vestal et al. "Resolution and Mass Accuracy in Matrix-Assisted Laser Desorption Ionization-Time-of-Flight" Journal of the American Society for Mass Spectrometry 9(9):892-911 (1998).

Vitek® MS, MALDI-TOF Mass Spectrometry Identification, bioMerieux, product description, http://www.vitekms.com/technology.html, date unknown but believed to be before the priority date of the present application, printed from the internet Aug. 27, 2015, (1 page).

Watson et al. "Time-Lag Focusing, Introduction to mass spectrometry instrumentation, applications, and strategies for data interpretation" John Wiley & Sons, Ltd., West Sussex, England (p. 66) (Dec. 4, 2007).

Wiley et al. "Time-of-Flight Mass Spectrometer with Improved Resolution" Review of Scientific Instruments 26(12):1150-1157 (1955).

* cited by examiner

CALCULATED RESOLVING POWER INCLUDING 10 ns JITTER FOR FIVE DIFFERENT FOCUS MASSES WITH 0.8 AND 1.6 METER LONG FLIGHT TUBES

CALCULATED MEAN RESOLVING POWER FROM 0-150 kDa INCLUDING 10 ns JITTER FOR FIVE DIFFERENT FLIGHT TUBE LENGTHS AS A FUNCTION OF FOCUS MASS. MEAN RESOLVING POWER INCREASES WITH BOTH FOCUS MASS AND FLIGHT TUBE LENGTH.

SIMPLIFIED DIAGRAM OF TIME-OF-FLIGHT (TOF) SYSTEM

PLOT OF THEORETICAL FOCUS MASSES WHICH CORRESPOND TO GIVEN EXTRACTION DELAY TIMES.

MASS SPECTRUM GENERATED BY AVERAGING THE MASS SPECTRA OF 16 SAMPLES OF ATCC 8739 *E. coli* WITH AN EXTRACTION DELAY TIME OF 200 ns.

MASS SPECTRUM GENERATED BY AVERAGING THE MASS SPECTRA OF 16 SAMPLES OF ATCC 8739 *E. coli* WITH AN EXTRACTION DELAY TIME OF 500 ns.

MASS SPECTRUM GENERATED BY AVERAGING THE MASS SPECTRA OF 16 SAMPLES OF ATCC 8739 *E. coli* WITH AN EXTRACTION DELAY TIME OF 800 ns.

MASS SPECTRUM GENERATED BY AVERAGING THE MASS SPECTRA OF 16 SAMPLES OF ATCC 8739 *E. coli* WITH AN EXTRACTION DELAY TIME OF 1,100 ns.

MASS SPECTRUM GENERATED BY AVERAGING THE MASS SPECTRA OF 16 SAMPLES OF ATCC 8739 *E. coli* WITH AN EXTRACTION DELAY TIME OF 1,400 ns.

MASS SPECTRUM GENERATED BY AVERAGING THE MASS SPECTRA OF 16 SAMPLES OF ATCC 8739 *E. coli* WITH AN EXTRACTION DELAY TIME OF 1,700 ns.

MASS SPECTRUM GENERATED BY AVERAGING THE MASS SPECTRA OF 16 SAMPLES OF ATCC 8739 *E. coli* WITH AN EXTRACTION DELAY TIME OF 2,000 ns.

MASS SPECTRUM GENERATED BY AVERAGING THE MASS SPECTRA OF 16 SAMPLES OF ATCC 8739 *E. coli* WITH AN EXTRACTION DELAY TIME OF 2,300 ns.

Mass spectrum generated by averaging the mass spectra of 16 samples of ATCC 8739 E. coli with an extraction delay time of 200 ns. The mass spectrum is zoomed to 4–10 kDa and peak

**Mass spectrum generated by averaging the mass spectra of 16 samples of ATCC 8739 *E. coli* with an extraction delay time of 800 ns. The mass spectrum is zoomed to 4 –10 kDa and peak labels have been removed for clarity.**

**Mass spectrum generated by averaging the mass spectra of 16 samples of ATCC 8739 *E. coli* with an extraction delay time of 1,400 ns. The mass spectrum is zoomed to 4 –10 kDa**

MASS SPECTRUM GENERATED BY AVERAGING THE MASS SPECTRA OF 48 SAMPLES OF ATCC 8739 *E. coli*. THE 48 SAMPLES WERE COMPRISED OF THREE GROUPS OF 16 SAMPLES WITH EXTRACTION DELAY TIMES OF 200 ns, 800 ns, AND 1400 ns, RESPECTIVELY.

MALDI-TOF MASS SPECTROMETERS WITH DELAY TIME VARIATIONS AND RELATED METHODS

RELATED APPLICATIONS

This application is a continuation application of U.S. application Ser. No. 16/058,016, filed Aug. 8, 2018, which is a continuation application of U.S. application Ser. No. 15/362,979, filed Nov. 29, 2016, now U.S. Pat. No. 10,068,760, issued Sep. 4, 2018, which is a continuation application of U.S. application Ser. No. 14/837,832, filed Aug. 27, 2015, now U.S. Pat. No. 9,536,726, issued Jan. 3, 2017, which claims the benefit of and priority to U.S. Provisional Application Ser. No. 62/043,533, filed Aug. 29, 2014, the contents of which are hereby incorporated by reference as if recited in full herein.

FIELD OF THE INVENTION

The present invention relates generally to mass spectrometry, in particular to time-of-flight mass spectrometers.

BACKGROUND OF THE INVENTION

Mass spectrometers are devices which vaporize and ionize a sample and then determine the mass to charge ratios of the collection of ions formed. One well known mass analyzer is the time-of-flight mass spectrometer (TOFMS), in which the mass to charge ratio of an ion is determined by the amount of time required for that ion to be transmitted under the influence of pulsed electric fields from the ion source to a detector. The spectral quality in TOFMS reflects the initial conditions of the ion beam prior to acceleration into a field free drift region. Specifically, any factor which results in ions of the same mass having different kinetic energies and/or being accelerated from different points in space will result in a degradation of spectral resolution, and thereby, a loss of mass accuracy. Matrix assisted laser desorption ionization (MALDI) is a well-known method to produce gas phase biomolecular ions for mass spectrometric analysis. The development of delayed extraction (DE) for MALDI-TOF has made high resolution routine for MALDI-based instruments. In DE-MALDI, a short delay is added between the ionization event, triggered by the laser, and the application of the accelerating pulse to the TOF source region. The fast (i.e., high-energy) ions will travel farther than the slow ions thereby transforming the energy distribution upon ionization to a spatial distribution upon acceleration (in the ionization region prior to the extraction pulse application).

See U.S. Pat. Nos. 5,625,184, 5,627,369 and 5,760,393. See also, Wiley et al., *Time-of-flight mass spectrometer with improved resolution*, Review of Scientific Instruments vol. 26, no. 12, pp. 1150-1157 (2004); M. L. Vestal, *Modern MALDI time-of-flight mass spectrometry*, Journal of Mass Spectrometry, vol. 44, no. 3, pp. 303-317 (2009); Vestal et al., *Resolution and mass accuracy in matrix-assisted laser desorption ionization-time-of-flight*, Journal of the American Society for Mass Spectrometry, vol. 9, no. 9, pp. 892-911 (1998); and Vestal et al., *High Performance MALDI-TOF mass spectrometry for proteomics*, International Journal of Mass Spectrometry, vol. 268, no. 2, pp. 83-92 (2007). The contents of these documents are hereby incorporated by reference as if recited in full herein.

SUMMARY OF EMBODIMENTS OF THE INVENTION

Embodiments of the present invention are directed to DE-MALDI-TOF MS systems that can operate with successive automated varying delay times for extraction pulses to vary a focus mass for a given accelerating and extraction voltage for mass signal acquisition and analysis of a single sample.

Embodiments of the invention are directed to delayed extraction (DE) matrix assisted laser desorption ionization (MALDI) time-of-flight mass spectrometers (TOF MS). The DE-MALDI TOF MS includes: a housing enclosing an analysis flow path; a solid state laser in optical communication with the analysis flow path; a variable voltage input; a delayed extraction plate connected to the variable voltage input; a flight tube in the housing, residing upstream of the delayed extraction plate and defining a free drift portion of the analysis flow path; a detector in communication with the flight tube; and a variable delay time module in communication with the laser and the variable voltage input configured to operate the variable voltage input with a plurality of different successive delay times during signal acquisition of a single sample. Each respective delay time is increased or decreased from another delay time by between about 1 nanosecond to about 500 nanoseconds to thereby obtain signal with a plurality of different focus masses at the detector.

The flight tube can have a length that is between about 0.4 m and about 1 m. However, longer or shorter lengths may optionally be used.

The solid state laser can be an ultraviolet laser, an infrared laser or a visible light laser.

The solid state laser can be an ultraviolet laser is configured to transmit a laser beam with a wavelength between about 340 nm and 370 nm.

The DE-MALDI-TOF MS can include a delayed extraction pulse generator in communication with a voltage supply and the variable delay time module.

The plurality of different successive delay times can include between 3-10 different delay times of between 1 nanosecond and 2400 nanoseconds during a cumulative signal acquisition time of between about 20 to about 30 seconds for a respective single sample.

The plurality of different successive delay times can progressively increase in length.

The focus masses can be between 2000 and about 20,000 Dalton.

The laser can be configured to input an ultraviolet laser beam with an energy between about 1-10 microjoules measured at a target and a pulse width between about 2-5 nanoseconds.

The DE-MALDI-TOF MS can include an analysis module in communication with the detector and/or a controller of the MALDI-TOF MS. The analysis module can be configured to generate at least one of a superimposed spectrum or a composite spectrum of m/z peaks from signal obtained by the detector during different passes at different time delays of the MALDI TOF MS.

The variable delay time module can be in communication with or integrated into a delayed extraction pulse generator and is configured to select a subsequent delay time or delay times for respective samples based on sample specific spectrums from a prior pass of a known delay time to thereby have an adaptive delay time capability.

The DE-MALDI-TOF MS can include a digitizer in communication with the detector. The variable time delay module can be incorporated at least partially into a control circuit or component of a control circuit which is also configured to provide a trigger timing control for activating the digitizer in communication with the detector.

A method of analyzing a sample in a delayed extraction (DE) matrix assisted laser desorption ionization (MALDI) time-of-flight mass spectrometer (TOF MS) includes electronically automatically varying delay times between pulsed ionization and acceleration to collect signal of a single sample with different focus masses at a detector.

The electronically automatically varying delay times can be carried out to progressively increase delay times.

The delay times can be increased or decreased from another delay time by between 1-500 nanoseconds with a delay time of between 1 nanosecond and 2500 nanoseconds.

The different delay times can be between 3-10 different delay times for a respective single sample.

A cumulative signal acquisition time for a respective single sample can be under 60 seconds, typically between about 20 to about 30 seconds.

The method can include, before the electronically automatically varying delay times, obtaining a first baseline pass of signal at a first delay time, determining if peaks of interest reside outside a predetermined range on either side of a focus mass of the first baseline pass, and selecting different delay times for the electronically automatically varying step based on if peaks of interest reside outside the predetermined range.

The method can include electronically switching laser pulses on and off and controlling initiation of accelerating voltage to generate the varying delay times.

Respective delay times can change by between about 10 nanoseconds to about 300 nanoseconds.

The sample can be undergoing analysis to determine whether one or more microorganisms are present in a mass range between about 2000 to about 20,000 Dalton.

The sample can be undergoing analysis to determine if one or more different types of bacteria may be present in a mass range between about 2000-20,000 Dalton.

The method can include identifying a microorganism in the sample based on the signal.

The method can include electronically generating a composite spectrum based on the signal of the single sample at the different focus masses.

The composite spectrum can be an average of the signals of the single sample at two or more of the different focus masses.

The method can include electronically generating a superimposed spectrum based on the signal of the single sample at the different focus masses.

The method can include: conducting a pass at a known delay time and focus mass to generate a first spectrum; electronically analyzing a resolution of the first spectrum; and electronically determining a change to the delay time to increase the resolution of the signal. The respective different delay times can be increased or decreased from other delay times by between 50 nanoseconds and 300 nanoseconds, with a delay time in a range of between 50 nanoseconds and 2400 nanoseconds.

Still other embodiments are directed to computer program products for a delayed extraction (DE) matrix assisted laser desorption ionization (MALDI) time-of-flight mass spectrometer (TOF MS). The computer program product includes a non-transitory computer readable storage medium having computer readable program code embodied in the medium. The computer-readable program code including computer readable program code configured to operate the MALDI-TOF MS with a plurality of different delay times for a respective single sample. Respective different delay times are increased or decreased from other delay times by between 1 nanosecond and 500 nanoseconds.

The computer program products can include computer readable program code configured to generate a composite and/or superimposed signal from spectra collected over a plurality of passes by a detector of the MALDI-TOF MS at the different delay times for different focus masses and a cumulative signal acquisition time in under 60 seconds, typically between about 20-30 seconds.

The respective different delay times are increased or decreased from other delay times by between 50 nanoseconds and 300 nanoseconds:

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1A:
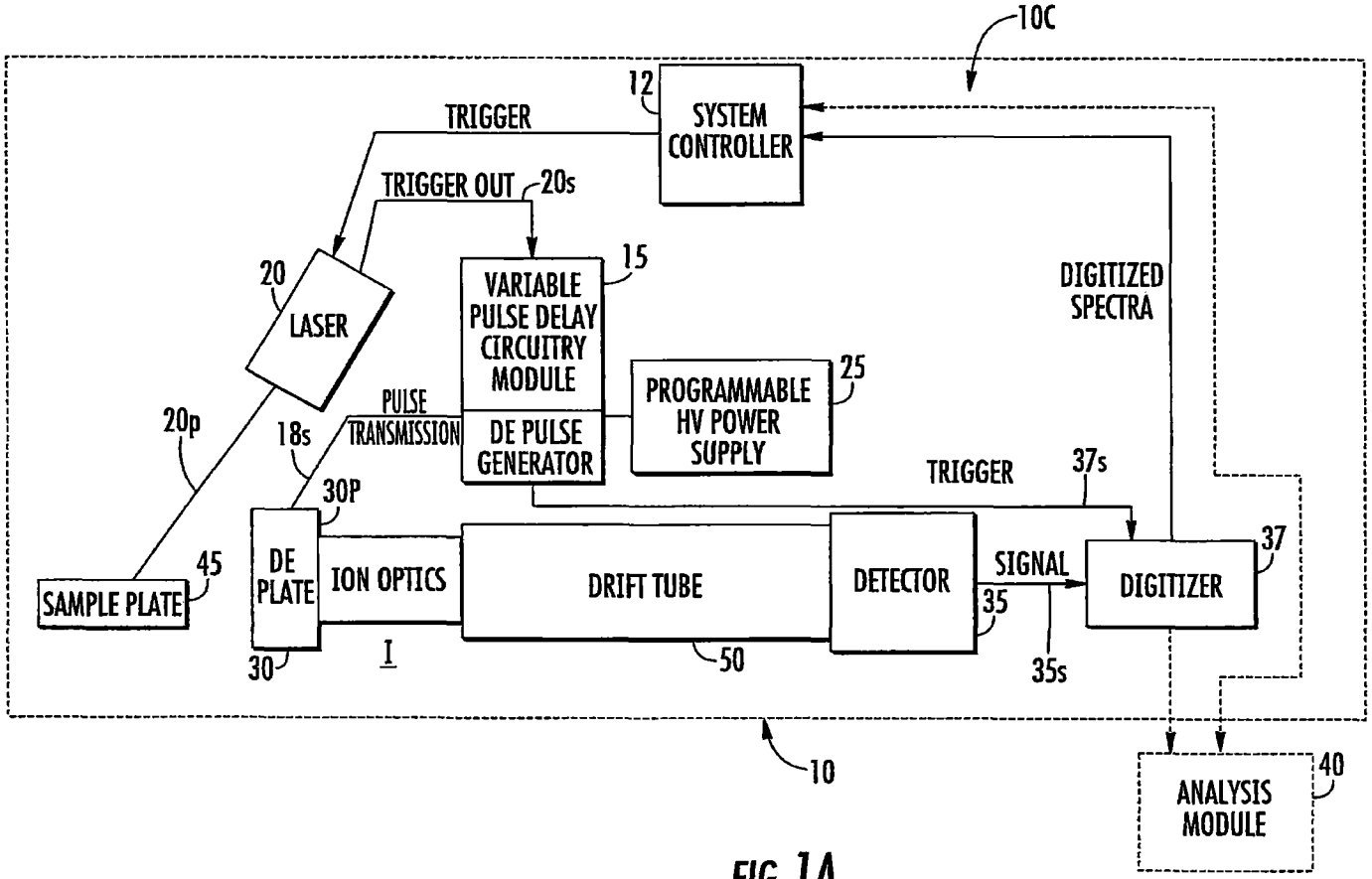
FIG. 1A is a block diagram of an exemplary circuit for a DE-MALDI-TOF MS according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10'").

In the figures, certain layers, components or features may be exaggerated for clarity, and broken lines illustrate optional features or operations unless specified otherwise. The terms "FIG." and "Fig." are used interchangeably with the word "Figure" in the application and/or drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "signal acquisition time" refers to the time that a digital signal of mass spectra of a single sample is collected or acquired from a detector of a mass spectrometer for analysis of the sample.

The terms "time delay" and "delay time" are used interchangeably and refer to a time between laser flash (firing/transmission) and ion extraction, i.e., between ionization and acceleration, for delayed extraction.

In some embodiments, the delay times can be used to obtain ion signal from a sample that is in the mass range between about 2,000 to about 20,000 Dalton.

The term "pass" refers to a single spectra collection, e.g., one full sweep across a spot. The term "shot" refers to the generation and collection of a single spectra.

The term "sample" refers to a substance undergoing analysis and can be any medium within a wide range of molecular weights. In some embodiments, the sample is being evaluated for the presence of microorganisms such as bacteria or fungi. However, the sample can be evaluated for the presence of other constituents including toxins or other chemicals.

The term "substantially the same" when referencing the peak resolution means that the spectra over a target range, typically between 2 kDa to 20 kDa, between 3 kDa to 18 kDa, and/or between about 4 kDa to 12 kDa, have a resolution that is within 10% of a defined focus mass peak resolution. Examples of focus masses are 4 kDa, 8 kDa, 12 kDa and 18 kDa.

The term "jitter" refers to deviation from true periodicity of a presumed periodic signal in electronics, often in relation to a reference clock source. In relation to MALDI-TOF, as is known to those of skill in the art, calibration or adjustment factors can be applied to power resolution calculations to account for jitter. For example, mass calibration can be used to compensate for timing jitter as can some protocols or methods in, for example, bacterial identification algorithms. It is noted that while compensations for jitter can help, it may be particularly suitable to reduce or minimize jitter to be as low as reasonably achievable to maximize resolving power.

The term "table top" refers to a relatively compact unit that can fit on a standard table top or counter top or occupy a footprint equivalent to a table top, such as a table top that has a width by length dimensions of about 1 foot by 6 foot, for example, and which typically has a height dimension that is between about 1-4 feet. In some embodiments, the system resides in an enclosure or housing of 28 inches (W)×28 inches (D)×38 inches (H).

Embodiments of the invention provide a varying time delay associated with respective delayed extractions that can generate spectra that have an extended resolution over a larger range compared to spectra collected from a sample using single fixed time delay.

Figure 1B:
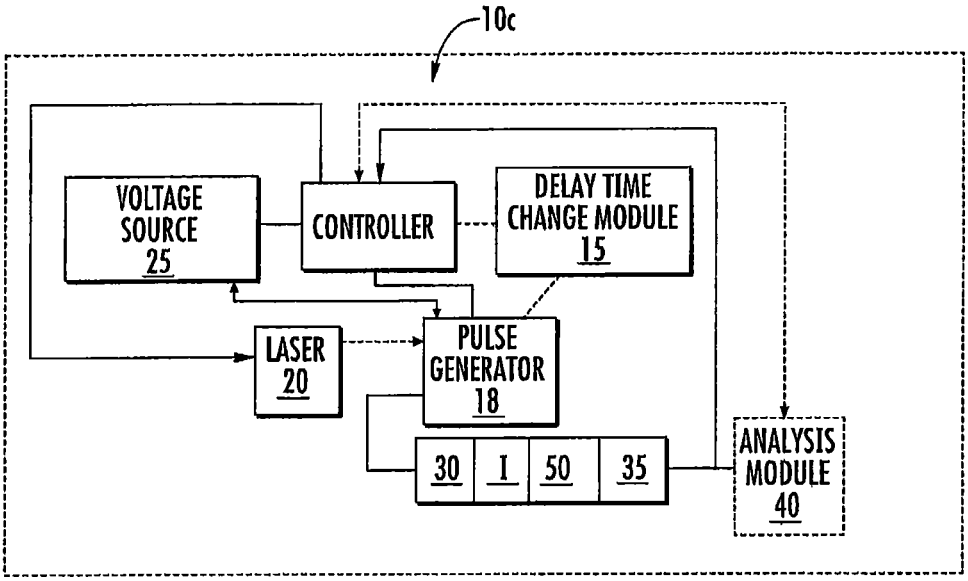
FIG. 1B is another block diagram of an exemplary circuit for a DE-MALDI-TOF MS according to embodiments of the present invention.
Figure 1C:
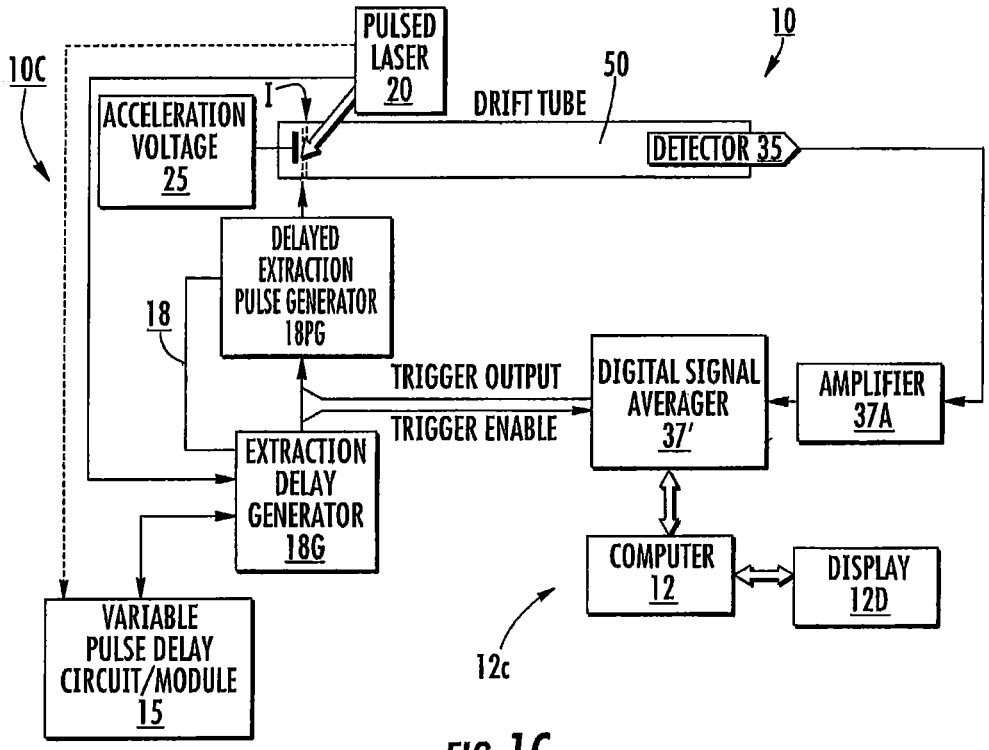
FIG. 1C is another block diagram of an exemplary circuit for a DE-MALDI-TOF MS according to embodiments of the present invention.

FIGS. 1A-1C illustrate exemplary circuits 10*c* of DE-MALDI TOF MS systems 10. The circuits 10*c* include at least one controller 12 (which may be provided in a computer 12*c* with a display 12*d*, FIG. 1C), a variable delay time change module 15, a solid state laser 20, at least one voltage source 25, and at least one detector 35.

Figure 3A:
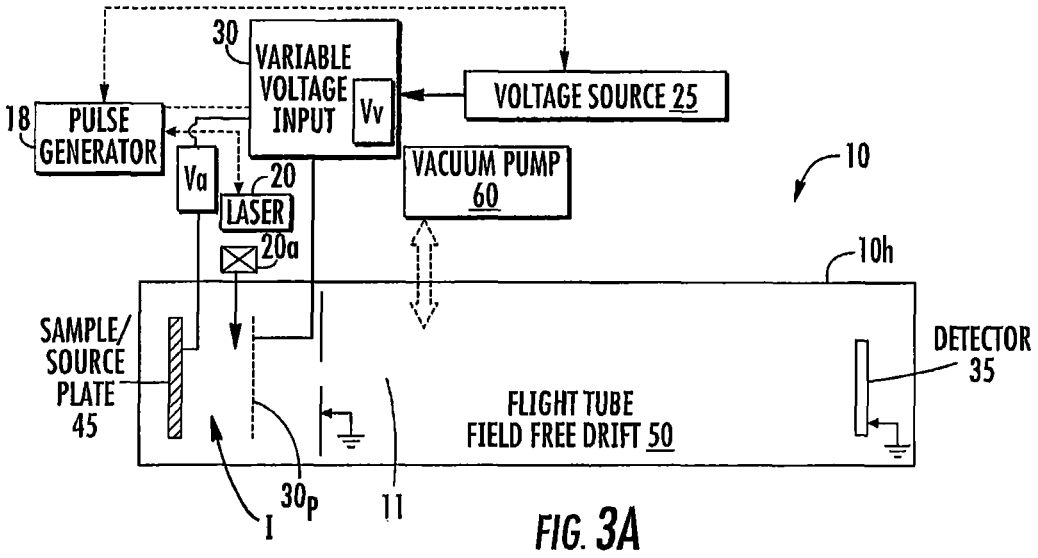
FIG. 3A is a schematic illustration of a DE-MALDI-TOF MS system according to embodiments of the present invention.
Figure 3B:
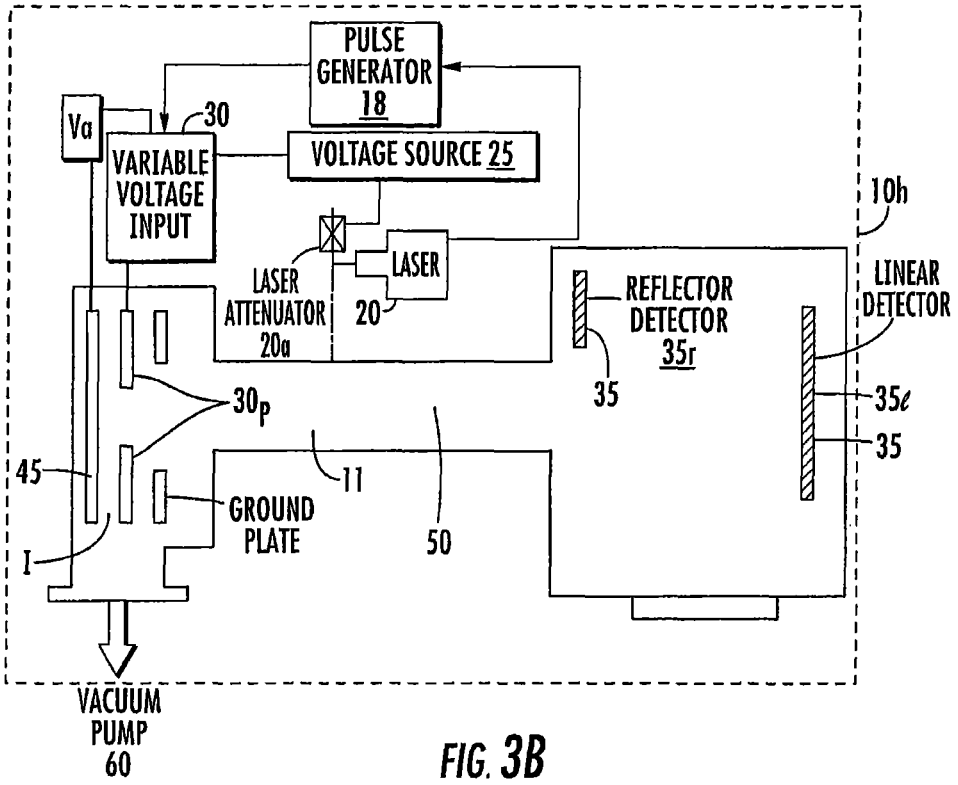
FIG. 3B is a schematic illustration of another DE-MALDI-TOF MS system according to embodiments of the present invention.

The term "module" refers to hardware or firmware or hardware and firmware or hardware (e.g., computer hardware) and software components. The variable pulse delay module 15 can include at least one processor and/or electronic memory programmed with software or programmatic code with mathematical equations, look-up tables and/or defined algorithms that select/generate different delay times for a respective sample under analysis. The module 15 can be configured to direct a pulse generator 18 to (successively) operate at pre-defined delayed extraction times and/or adaptively select different delay times for different firings of the laser when analyzing a single sample. Thus, the module 15 is configured to select and/or change a delayed extraction pulse time for operation of the MS system 10 when analyzing respective single samples. The module 15 can be integrated into a single device, e.g., onboard the laser system 20, onboard the pulse generator 18, or in the controller 12. The module 15 can be a separate/discrete module such as a printed circuit board and/or processor in communication the laser 20 and/or the pulse generator 18, for example. The module 15 can be distributed in various components and may be local or remote to the MS system 10. The system 10 also includes a TOF tube 50 (FIGS. 1A, 3A, 3B). The system 10 can further include a delayed extraction plate 30*p* that resides upstream of the TOF tube 50. As shown in FIG. 1A, for example, the delayed extraction plate 30*p* resides between the sample 45 and the TOF tube 50. The delayed extraction plate 30*p* is connected to a variable voltage input 30, which is in turn connected to one or more other elements. For example, the variable voltage input 30 may also be connected to the voltage source 25 and/or the sample plate 45. The variable voltage input 30 applies a voltage to the delayed extraction plate 30*p* and/or the sample plate 45 and this voltage can be varied to determine the strength of the electric field.

The delayed extraction plate 30*p* may be gridded or gridless. For example, as shown in FIG. 3A, the delayed extraction plate 30*p* includes a grid through which the ions pass into the flight tube. In FIG. 3B, in contrast, the delayed extraction plate 30*p* is a gridless design with an aperture in the ion optics through which ions pass into the flight tube 50. Commercial gridless ion optic systems include the VITEK MS system from BioMerieux, Inc. (having a place of business in Durham, N.C., USA and corporate headquarters in France). See also, U.S. Pat. No. 6,717,132, incorporated by reference by way of example only. In contrast, generally stated, gridded ion optic systems include grids that extend across the aperture (similar to a wire grid/screen) to make the electric field more uniform.

The circuit 10*c* may also optionally include an electronic (e.g., digital) delayed extraction pulse generator 18 for creating the variable delay times. The pulse generator 18 can be configured to communicate with the controller 12 and/or the at least one voltage source 25 and/or laser 20. The term "in communication with" refers to both wireless and wired electrical, optical, and/or electronic connections.

As shown in FIGS. 1A-1C, the circuit 10*c* can include a delayed extraction pulse generator 18 which is in communication with a voltage source (e.g., power supply) 25 and that transmits the delayed extraction pulse signal 18*s* to the voltage input 30. FIG. 1A illustrates that the voltage input 30 can comprise a delayed extraction plate 30*p* with or without a grid adjacent the TOF tube 50 (at an end away from the detector 35). As also shown in FIG. 1A, the voltage source 25 can comprise a programmable high voltage power supply.

The detector 35 can be in communication with a digitizer 37 that collects signal from the detector 35. The digitizer 37 can transmit the detector signal 35*s* (spectra) to the controller 12 and/or to an analysis module 40. The digitizer 37 can be a commercially available or custom digitizer. One commercially available digitizer is the Keysight U5309A digitizer from Keysight Technologies (a company originating from Agilent Technologies, Santa Rosa, Calif.).

The controller 12, the laser 20 and/or the delayed extraction pulse generator 18 can be in communication with the digitizer 37 so as to transmit a trigger signal 37*s* to the digitizer 37. The trigger signal 37*s* can be sent based on when the laser 20 is fired to collect signal 35*s*. That is, as shown in FIG. 1A, the digitizer 37 and/or detector 35 can operate with a trigger signal 37*s* to synch operation based on when the laser 20 fires, shown as using a trigger out signal 20*s* from the laser 20 and/or when the delayed extraction (DE) pulse 18*s* is sent to the voltage input 30.

As shown in FIG. 1A, in some embodiments, the laser 20 can transmit a trigger out signal 20*s* to the variable pulse delay circuitry/module 15 which can be used to direct the delayed extraction pulse generator 18 to transmit the delayed extraction pulse 18*s* to the (variable) voltage input 30 using a selected (adjustable or variable) delay time for respective samples. This action can be repeated in quick succession at least once for each sample using a different delay time for the extraction pulse 18*s* to allow for spectral collection of a respective sample in about 60 seconds or less, typically in about 30 seconds or less, in some embodiments.

FIG. 1C illustrates that the delayed extraction pulse generator 18 can include an extraction delay generator 18G that is in communication with the variable pulse delay circuitry/module 15 and that communicates with a delayed extraction pulse generator 18PG. The extraction delay generator 18G can transmit a trigger signal to a digitizer 37' that may be configured as a digital signal averager. The digitizer 37' can be in communication with an amplifier 37A that collects signal from the detector 35. The signal averager 37' can have a trigger output that can feed to the DE pulse generator 18PG. The averager 37' can comprise the FAST-FLIGHT™ Digital Signal Averager from ORTEC®/Ametek, Oak Ridge, Tenn. or other digitizers as noted above.

Again, generally stated, the laser 20 sends out a synchronization signal to the variable pulse delay circuitry/module 15 which communicates with the extraction delay generator 18G so that the delayed extraction pulse is synchronized with a time delay from the firing of the laser 20. The data acquisition by the digitizer 37' can also be synchronized to the firing of the laser 20 and the extraction pulse generator 18 so that the digitizer 37' will start acquiring signal from the detector 35 a certain time delay after the delayed extraction occurs.

FIGS. 1A-1C are exemplary illustrations of circuits for providing the laser input with variable delay times. However, it is contemplated that the time delay variations can be provided or controlled using other devices or configurations.

The laser 20 can be configured to transmit a laser pulse to an ionization region I of the mass spectrometer 10 (e.g., for pulsed ionization) which can be proximate the target sample undergoing analysis, typically on a matrix on a sample plate 45 (FIGS. 1A, 3A, 3B).

The detector 35 can be a linear detector 35*l* and/or a reflector detector 35*r* (FIG. 3A, 3B) or any other appropriate detector. If a reflector detector, the system 10 can include reflectors between the farthest end of the flight tube (the end away from the source/ionization region) and the reflector detector as is well known.

MALDI-TOF MS systems are well known. See, e.g., U.S. Pat. Nos. 5,625,184; 5,627,369; 5,760,393; 6,002,127; 6,057,543; 6,281,493; 6,541,765, and 5,969,348, the contents of which are hereby incorporated by reference as if recited in full herein. The majority of modern MALDI-TOF MS systems employ delayed extraction (e.g., time-lag focusing) to mitigate the negative spectral qualities of ion initial energy distribution. In the past, the MALDI-TOF MS systems provided optimal resolving power for a given delay time at only a single ion mass to charge ratio, known as the "focus mass." Based on information and belief, in the past, the delay time was fixed for a given sample analysis and/or mass spectrometer design. Thus, in the past, the fixed delay time in DE-MALDI only optimized performance across a relatively narrow range of mass to charge ratios. Accordingly, resolution could unduly vary across the acquired or target spectrum and calibration may be non-linear.

In embodiments of the present invention, the system 10 can operate with different, typically rapidly successive and different, delay times for collecting spectra for analysis of a single sample.

The (at least one) controller 12 can determine when the laser 20 fires and direct the voltage source(s) 25 (typically through the delayed extraction pulse generator 18) to operate to provide the accelerating voltage input with a suitable delay time ("td2"). In some embodiments, a clock signal or other trigger signal from the laser 20 and/or pulse generator 18 can be used to identify the "firing" used to time (synch) a time used to identify/activate/generate and/or select desired delay times. The difference in different delay times can be between about 1 nanosecond to about 500 nanoseconds. Successively different delay times can be provided automatically as dynamically changed delay times that can provide pulsed extraction and which may provide rapid analysis (typically under 30 seconds per sample, for samples being analyzed for identification of biomolecules and/or microorganisms such as bacteria). The systems may have a high resolving power over a large range of mass-to-charge ratios.

In some embodiments, the MS systems 10 generate the different delay times to generate different focal masses that can be used to generate signal/mass spectra that can identify a sample or a constituent of a sample in a time frame that corresponds to that of a single focal mass in conventional MALDI-TOF MS systems. This operational protocol can allow the identification of samples and/or constituents of samples with a single mass spectrometer with a short signal acquisition time and in a manner that does not require a user to tune the mass spectrometer prior to sample signal collection. Tuning of focal mass can be automated. Tuning may be based on an electronic (e.g., computer program and/or software-directed) analysis of initial spectra acquired. One example for a use of a different focal mass is to better separate a wide peak in a low resolution region to better resolve a doublet peak.

In some embodiments, the resolving power can be between about 2000-3000 for mass to charge ratios of interest over a range that can be between about one or more of: 2 kDa to about 20 kDa, 3 kDa to 18 kDa, and/or 4 kDa-12 kDa.

Figure 1D:
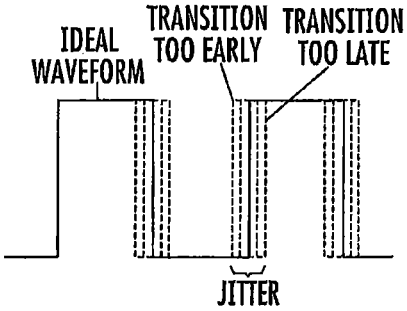
FIG. 1D is a graph illustrating an example of jitter that may occur in a timing diagram.

As shown in FIG. 1A, embodiments of the invention can include control circuits/analyzer systems that can synchronize the laser 20 firing of the pulse 20*p* with the delayed extraction pulse 18*s* and optionally to the initiation of digitization 37*s*. In operation, there may be some variation in the time delays due to jitter which can be corrected for using mass calibration and/or adjustment factors as is known to those of skill in the art but the system may also be configured to operate with low jitter to reach a desired resolution (which may not require adjustment or correction). FIG. 1D illustrates jitter in a timing waveform with an "ideal" waveform, and variations caused by jitter causing a transition too early or too late. Jitter can be caused by changes in temperature, crosstalk in electrical signals, switching variability, and the like. A description of jitter relevance to MALDI-TOF MS is given in: *Proteomics*. 2008 April; 8(8): 1530-1538, the contents of which are hereby incorporated by reference as if recited in full herein. As discussed in the cited document, two types of systematic instrumental error may be observed in TOF data: variations in the triggering time from spectrum to spectrum and small variations in the accelerating voltage. Triggering time errors, or jitter between spectra, are differences in the measured TOF start times due to variations in the output from the digitizing clock and supporting analog electronics. These timing errors appear as constant time offsets in TOF spectra and are expected to be at least ±1 time count. Since a triggering time error effects all time measurements in a spectrum equally, it can easily be eliminated by subtracting a constant from each time value. In addition to the start time jitter, any low frequency variation in the spectrometer acceleration voltage or any thermal expansion (or contraction) of the time-of-flight tube can produce an apparent linear dilation or contraction of the time measurement scale. As with the correction for jitter, a systematic error of this type can be eliminated by simultaneously correcting all the points in a spectrum. This type of error can be corrected with a simple linear scale factor. Id., *Proteomics*. 2008 April; 8(8): 1530-1538.

Figure 2A:
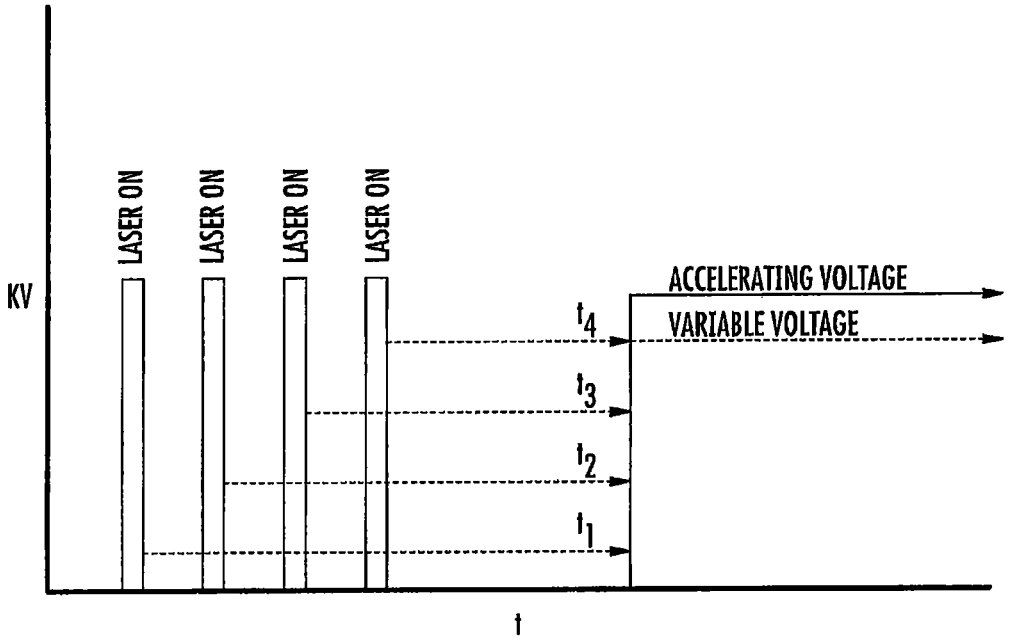
FIG. 2A is a timing graph illustrating successive varying delay times according to some embodiments of the present invention.
Figure 2B:
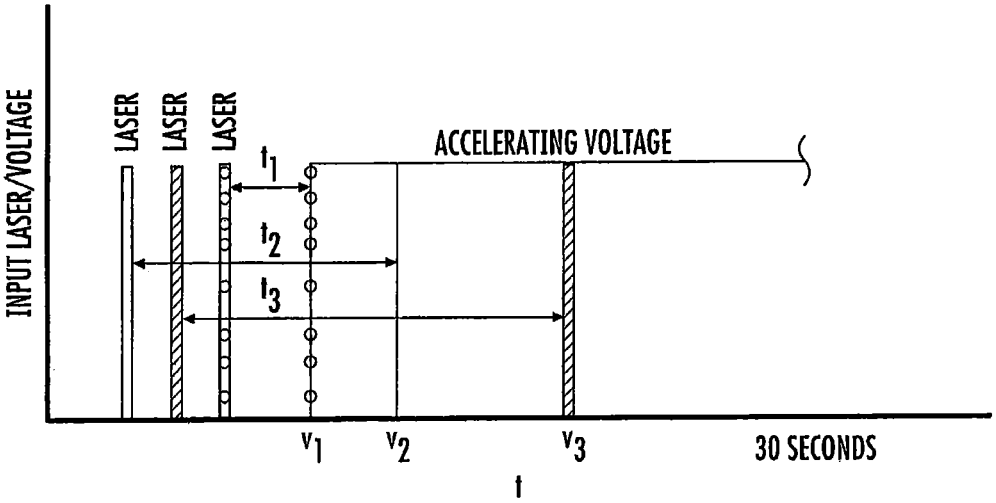
FIG. 2B is a timing graph illustrating successive varying delay times according to some embodiments of the present invention.

As schematically illustrated by timing diagrams in FIGS. 2A and 2B, embodiments of the invention provide MALDI-TOF MS systems 10 operable to automatically electronically employ a successive series of different delay times between ionization and acceleration (i.e., between firing of the laser and application of the extraction voltage/voltage potential) to analyze a respective single sample. The laser pulse width is typically between about 2-5 nanoseconds, but other pulses may be used. FIG. 2B shows that the successive delay times $t_1$-$t_3$ can be successively progressively increasing delay times, e.g., $t_1$ is the shortest and $t_3$ is the longest. FIG. 2A illustrates that the delay times can be successively, progressively decreasing delay times, e.g., the first delay time $t_1$ is the longest and the last delay time $t_4$ is the shortest. It is also contemplated that short and longer delay times can be interleaved, so that the successive delay times are not required to progressively increase or progressively decrease.

Respective delayed extraction delay times are typically between about 1 nanosecond and 500 nanoseconds and can be in even or odd time increments, typically with between two (2) and ten (10) successive different delay times for a respective sample. More typically, the successive different delay times may be provided in between about 4-6 different delay times for a respective single sample and in between about 10-30 seconds of signal acquisition time. Extraction delay times may fall within a range of 100 ns to 3000 ns for typical sample analysis.

Temporally, sequential extraction delay times for the DE pulse generator 18 for laser pulse transmission for a respective sample can vary, typically by between 1-500 nanoseconds from one to another, more typically by between about 10-500 nanoseconds or 10-300 ns, such as between about 50 to about 300 nanoseconds, including 50 ns, 60 ns, 70 ns, 80 ns, 90 ns, 100 ns, 110 ns, 120 ns, 130 ns, 140 ns, 150 ns, 160 ns, 170 ns, 180 ns, 180 ns, 190 ns, 200 ns, 210 ns, 220 ns, 230 ns, 240 ns, 250 ns, 260 ns, 270 ns, 280 ns, 290 ns, and 300 ns.

Figure 2C:
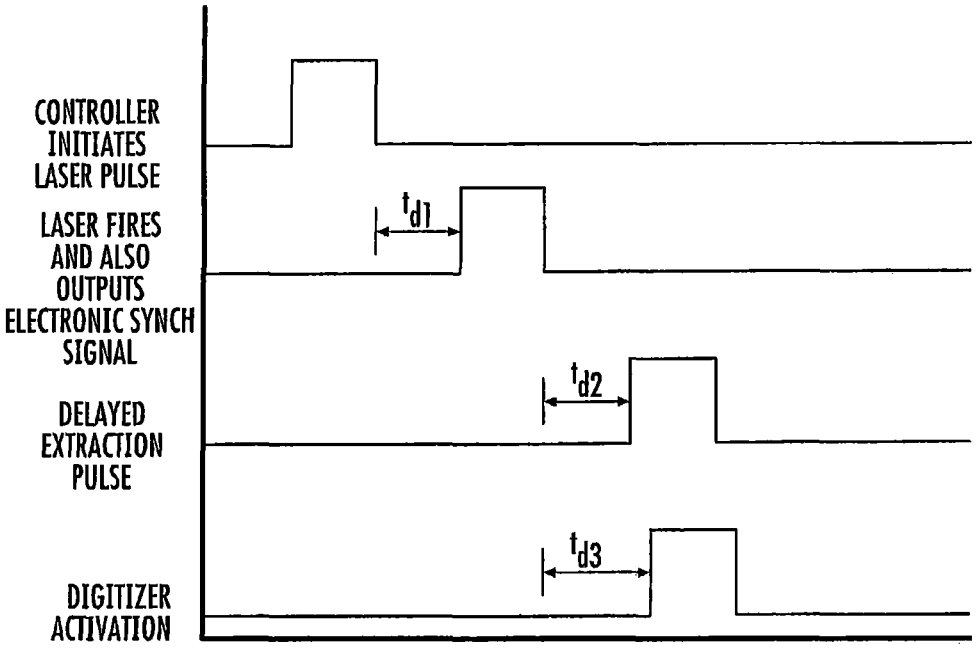
FIG. 2C is a single spectral acquisition timing diagram of a DE-MALDI-TOF MS system according to embodiments of the present invention.

FIG. 2C is a schematic illustration of a single spectral acquisition timing diagram of a MALDI-TOF MS system 10. Referring to FIG. 2C, the following sequential events can constitute a "shot" or single mass spectrometry acquisition event (which can be repeated at least once with a different delayed extraction voltage pulse delay time).

1. Once the sample (e.g., slide) is located and aligned in the mass spectrometer, the controller initiates a signal for the laser to fire. Time delay $t_{d1}$ is the time delay from controller initiation until laser firing.
2. The laser receives the signal and prepares for firing. An electronic synchronization signal is transmitted from the laser to other subsystems so that downstream events can be synchronized. This output has a tightly controlled offset time so that precise timing can be maintained.
3. The synchronization signal arrives at the Delayed Extraction circuitry and initiates the activation of the Delayed Extraction pulser. This time delay is primarily due to transit time for the electronic signal to propagate from the laser unit to the pulser (typically 1 nanosecond/foot propagation delay). Time delay $t_{d2}$ is the time delay from the laser firing to a voltage change in the Delayed Extraction plate which is controlled by the pulser.
4. The synchronization signal is also sent to the signal digitizer that is connected to the MALDI ion detector. It is beneficial to have a slightly longer time delay since it takes a few nanoseconds after the Delayed Extraction pulse for the first ions to strike the detector. Time delay $t_{d3}$ is the digitizer activation time delay.

In some embodiments, the laser 20 fires at a rate of about 1000 Hertz, so the process of firing the laser and acquiring the spectra should not be longer than 1 msec. On a 0.8 meter flight tube, it can take about 54 microseconds for a 17,000 Dalton ion to reach the detector 35. Thus, there is sufficient time available to increase delayed extraction and maintain a non-spectral overlap.

Typically, the detector 35 is operative to collect signal proximate in time to initiation of the acceleration voltage, e.g., with substantially the same delay time. The detector 35 can acquire signal over the course of a spectral acquisition (single firing of the laser). There is a gap where no ions strike the detector 35 that occurs between the laser firings.

Table 1 below provides examples of six, five and four successive delay times (in nanoseconds) t1 et seq. that can be used for respective TOF MALDI extraction pulse delay sequences t1-tn for a sequence of different delay times for a delayed extraction voltage pulse, e.g., td2, as shown in the timing diagram of FIG. 2C for generating data for analyzing respective samples. These successive delay times are provided as non-limiting examples only.

| Time delay | t1 (ns) | t2 (ns) | t3 (ns) | t4 (ns) | t5 (ns) | t6 (ns) |
|---|---|---|---|---|---|---|
| td2 sequence | 1 | 10 | 20 | 30 | 40 | 50 |
| td2 sequence | 10 | 1 | 5 | 20 | 30 | 60 |
| td2 sequence | 100 | 10 | 50 | 40 | 30 | 20 |
| td2 sequence | 10 | 20 | 30 | 40 | 50 | 60 |
| td2 sequence | 40 | 50 | 60 | 70 | 80 | 90 |
| td2 sequence | t1 | t2 | t3 | t4 | t5 | |
| td2 sequence | 40 | 50 | 60 | 70 | 80 | |
| td2 sequence | 80 | 70 | 60 | 50 | 40 | |
| td2 sequence | 10 | 70 | 60 | 50 | 40 | |
| td2 sequence | t1 | t2 | t3 | t4 | | |
| td2 sequence | 50 | 60 | 70 | 80 | | |
| td2 sequence | 800 | 700 | 600 | 500 | | |
| td2 sequence | t1 | t2 | t3 | t4 | t5 | |
| td2 sequence | 200 | 500 | 800 | 1100 | 1400 | |

The solid state laser 20 can facilitate rapid successive delay times, typically between 2-10, more typically between 4-6 different delay times, for a single sample analysis. The single sample analysis can use the successive different delay times typically with cumulative or total signal acquisition time between about 10-30 seconds.

The solid state laser 20 can be an ultraviolet laser with a wavelength above 320 nm. The solid state laser 20 can generate a laser beam with a wavelength between about 347 nm to about 360 nm. The solid state laser 20 can alternatively be an infrared laser or a visible light laser.

An example of a suitable commercially available solid state laser is the Spectra-Physics Explorer® One™ series which has models available in the UV at 349 nm and 355 nm. The Explorer One 349 nm device is offered with pulse energies of 60 μJ and 120 μJ at 1 kHz, while the Explorer One 355 nm model produces over 300 mW of average power at a repetition rate of 50 kHz. A laser attenuator 20*a* (FIGS. 3A, 3B) can be used to adjust the amount of laser power/energy transmitted to the target, i.e., to the ionization region I. In some embodiments, the laser 20 is configured to output laser pulses of between about 1-5 ns pulse widths (or even less than 1 ns) with between about 1-10 microjoules of energy measured at the target rather than at an exit/output of the laser. As used herein, "at the target" means the energy delivered to the sample at the sample plate. The sample can optionally be a biological sample with matrix—matrix is the material that absorbs the laser energy and vaporizes the matrix. In some embodiments, the laser energy (measured at the target) for obtaining spectra can have low pulse energies such as between 1-5 microjoules per pulse, again measured at the target, typically at 1.5 to 2.0 microjoules per pulse. However, it is noted that the requisite pulse energy (which value is measured at the target) is also related to the spot size of the laser (smaller spot requires lower energy while a larger spot size requires more energy) and may vary in different systems/embodiments. The wavelength and energy may be matrix dependent and/or may depend on other system parameters.

The laser 20 can be capable of a repetition rate that is between 1 kHz and 2 kHz, typically up to about 10 kHz. A given repetition rate is for a given acquisition time.

FIGS. 3A and 3B illustrate examples of DE-MALDI-TOF MS systems 10. However, the present invention is not limited to these configurations but can be used with any DE-MALDI-TOF MS system. The DE-MALDI-TOF MS system 10 can include a vacuum pump 60 that is in communication with the enclosed analysis flow chamber 11 and may be onboard the unit or housing 10*h* or connected thereto.

FIG. 3B illustrates the detector 35 can be a linear detector 35*l* or a reflector detector 35*r* or even both and/or a plurality of each type.

The accelerating voltage Va can be any suitable voltage, but is typically between about 10 kV and 25 kV, more typically about 20 kV. The variable voltage Vv can be less than the accelerating voltage, typically between about 70-90% of Va. As discussed above, the system 10 can include a pulse generator 18 and/or electronic input/output or control device that can be used to control and/or generate the variable delay times. It is also contemplated that the voltage polarity can be changed as long as the electric field vector is the same.

The flight tube 50 can have any suitable length, typically between about 0.4 m and 2 m. In some embodiments, the flight tube 50 has a length that allows the system 10 to be a table top MS system. The system 10 is held in or by a housing 10*h*. In some embodiments, the flight tube 50 has a length that is about 0.5 m, about 0.6 m, about 0.7 m, about 0.8 m, about 0.9 m or about 1 m. The flight tube 50 may also be longer than 1 m and, to be clear, the DE-MALDI MS system is not required to be a benchtop system.

Figure 3C:
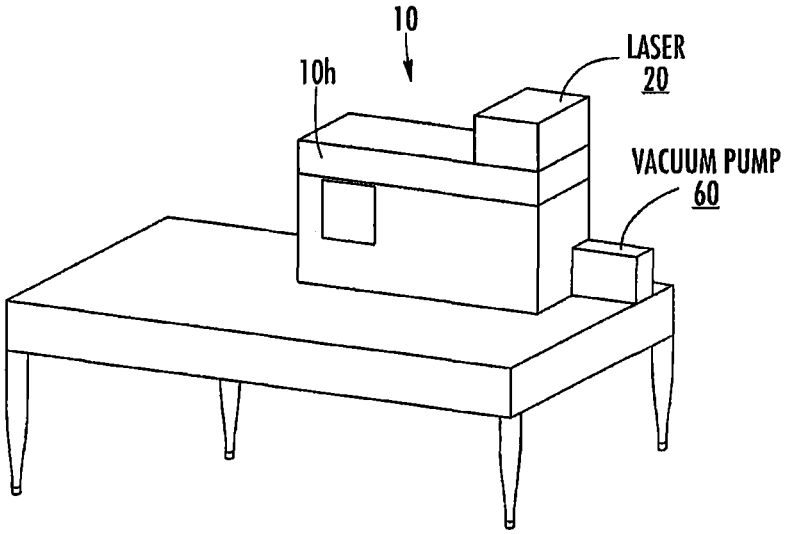
FIG. 3C is a schematic illustration of a table top sized DE-MALDI TOF MS system according to embodiments of the present invention.

FIG. 3C illustrates the MALDI-TOF system 10 as a table top system that houses the laser 20 and other components shown in FIG. 1A, 1B and/or 1C, for example. The vacuum pump 60 may be onboard the housing or provided as a plug-in component. The laser 20 can be onboard the housing 10*h* (e.g., inside the housing) or provided as an external plug in component.

While shown in FIG. 1B as a separate module 15 in communication with the controller 12, it can be integrated with the controller 12, be partially or totally held as a module in memory of the controller or be held partially or totally separate from the controller 12. The module 15 can also be held in a server 80 (FIG. 5) that is remote from the housing 10*h* of the MS system 10. The variable DE circuitry/module 15 may also be partially or totally held in the DE pulse generator 18 and/or laser 20. The variable DE circuitry/module 15 can be held partially or totally in a component and/or unit which also has other timing components of the DE-MALDI system 10.

The controller 12 can be and/or include at least one digital signal processor. The controller 12 can be and/or include an Application Specific Integrated Circuit (ASIC).

The circuit 10*c* may also include an analysis module 40. The multiple delay times can produce serial and separate spectra.

Figure 4:
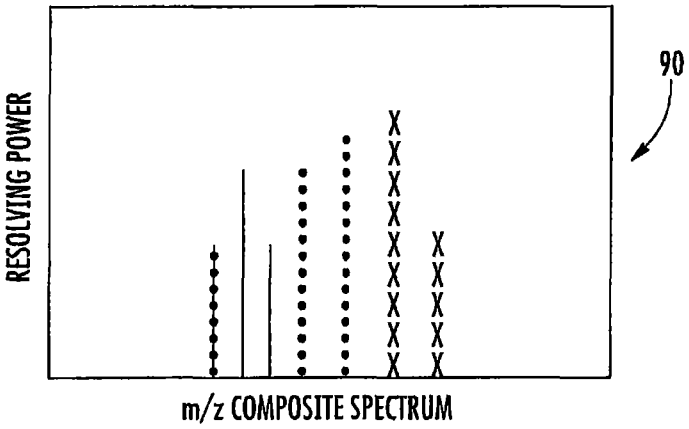
FIG. 4 is a schematic illustration of a composite report of a sample based on varied delay times for the scans according to embodiments of the present invention.

The controller 12 and/or analysis module 40 can generate a composite spectrum 90 (FIG. 4) such as by superimposing the spectrum from the different delay times into a composite signal spectrum 90. In some embodiments, the analysis module 40 can generate a composite spectrum using maximal peak resolutions for a respective mass to charge ratio as selected from one of the passes, e.g., signal from one of the delay times so that different peaks in a single composite spectrum may be from different delay times. The peaks can be visually coded by line type or icons and/or color-coded so that a user can visually recognize what time delay was used to provide a respective peak in the composite graph/spectrum. FIG. 4 schematically (prophetically) illustrates peaks from three different passes with three different focus masses (from three different delay times) can be used to generate the sample analysis m/z. The analysis module 40 can be configured to electronically select the maximal peaks from each signal and discard, flag as an error, or identify any peak that may have a statistically unlikely value, e.g., an outlier. The composite mass spectrum 90 can also or alternatively provide an average of the spectra obtained from different delay times (see also, FIG. 24). While the analysis module 40 is shown as a separate module in communication with the controller 12, it can be integrated with the controller 12, be partially or totally held as a module in memory of the controller, or be held partially or totally separate from the controller 12. The module 40 can also be partially or totally held in a server 80 (FIG. 5) that is remote from the housing 10*h* of the MS system 10.

Figure 5:
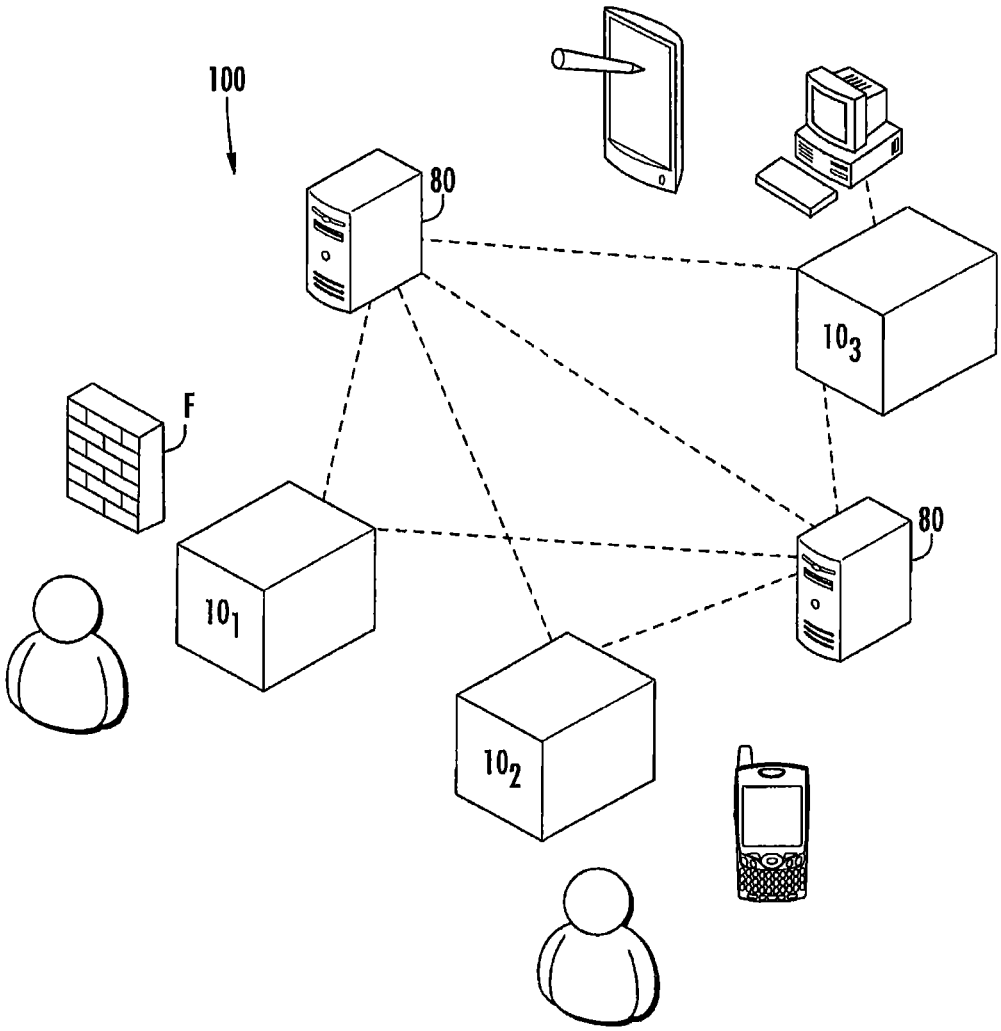
FIG. 5 is a schematic illustration of a networked system according to embodiments of the present invention.

FIG. 5 illustrates a networked system 100 with at least one server 80 (shown as two servers) and multiple DE-MALDI-MS systems 10 (shown as three systems by way of example, $\mathbf{10}_1$, $\mathbf{10}_2$, $\mathbf{10}_3$). The analysis module 40 and/or the delay time change module 15 can be partially or totally held by the at least one server. Suitable firewalls F can be provided and the data exchange configured to comply with HIPAA or other privacy guidelines. Sample analysis can be transmitted to various electronic systems or devices associated with defined users. The system 10 can include a patient record database and/or server that can include electronic medical records (EMR) with privacy access restrictions that are in compliance with HIPAA rules due to a client-server operation and/or privilege defined access for different users.

The at least one web server 80 can include a single web server as a control node (hub) or may include a plurality of servers. The system 100 can also include routers (not shown). For example, a router can coordinate privacy rules on data exchange or access. Where more than one server is used, different servers (and/or routers) may execute different tasks or may share tasks or portions of tasks. For example, the system 100 can include one or combinations of more than one of the following: a security management server, a registered participant/user directory server, a patient record management server, and the like. The system 100 can include firewalls F and other secure connection and communication protocols. For Internet based applications, the server 80 and/or at least some of the associated web clients can be configured to operate using SSL (Secure Sockets Layer) and a high level of encryption. Additional security functionality may also be provided. For example, incorporation of a communication protocol stack at the client and the server supporting SSL communications or Virtual Private Network (VPN) technology such as Internet Protocol Security Architecture (IPSec) may provide for secure communications to further assure a patient's privacy.

The MALDI-TOF systems 10 and/or the networked system 100 can be provided using cloud computing which includes the provision of computational resources on demand via a computer network. The resources can be embodied as various infrastructure services (e.g., compute, storage, etc.) as well as applications, databases, file services, email, etc. In the traditional model of computing, both data and software are typically fully contained on the user's computer; in cloud computing, the user's computer may contain little software or data (perhaps an operating system and/or web browser), and may serve as little more than a display terminal for processes occurring on a network of external computers. A cloud computing service (or an aggregation of multiple cloud resources) may be generally referred to as the "Cloud." Cloud storage may include a model of networked computer data storage where data is stored on multiple virtual servers, rather than being hosted on one or more dedicated servers.

Figure 6:
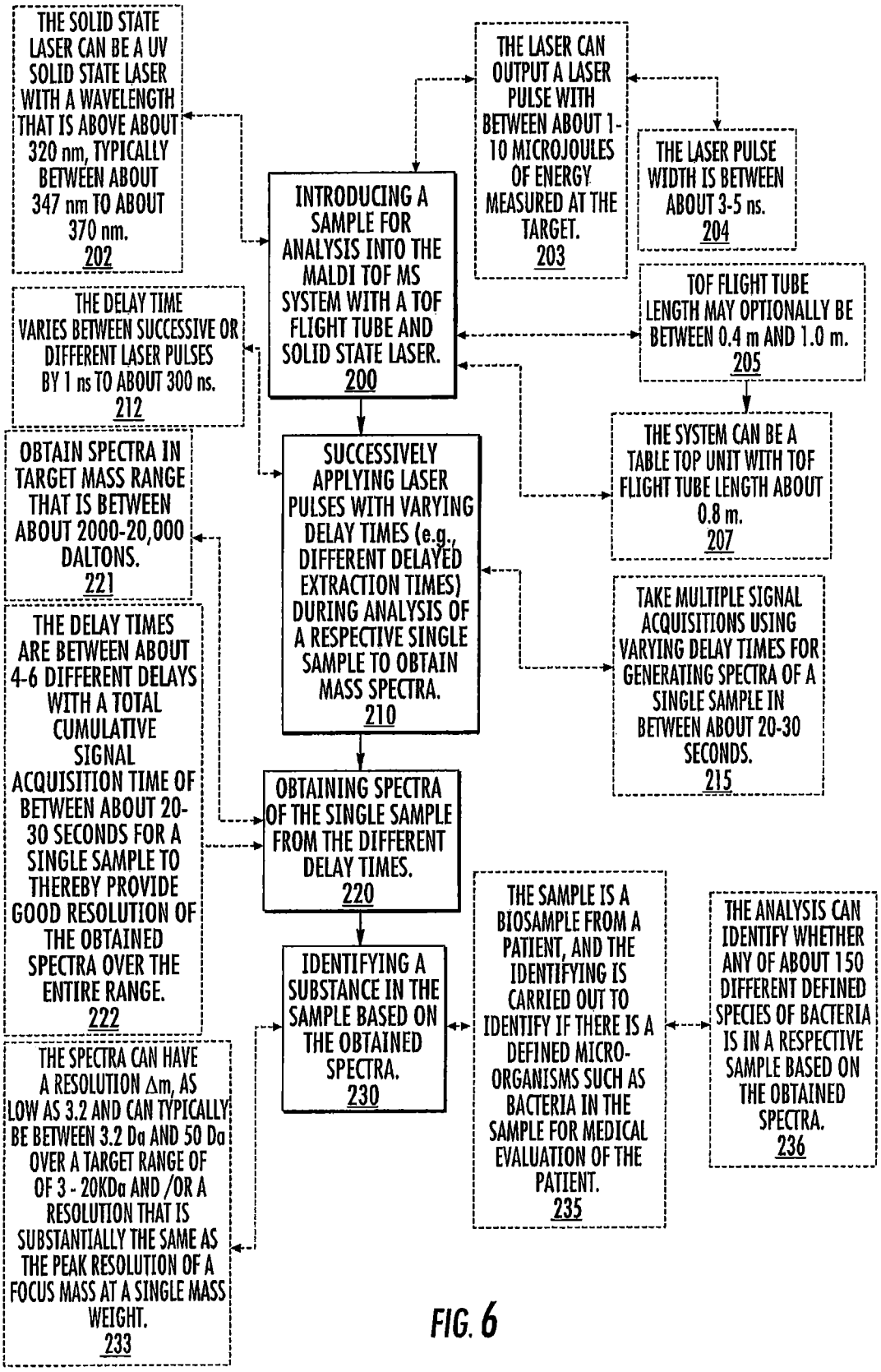
FIG. 6 is a flow chart of a "brute strength" protocol for changes in delay time for sample signal acquisition according to embodiments of the present invention.
Figure 7:
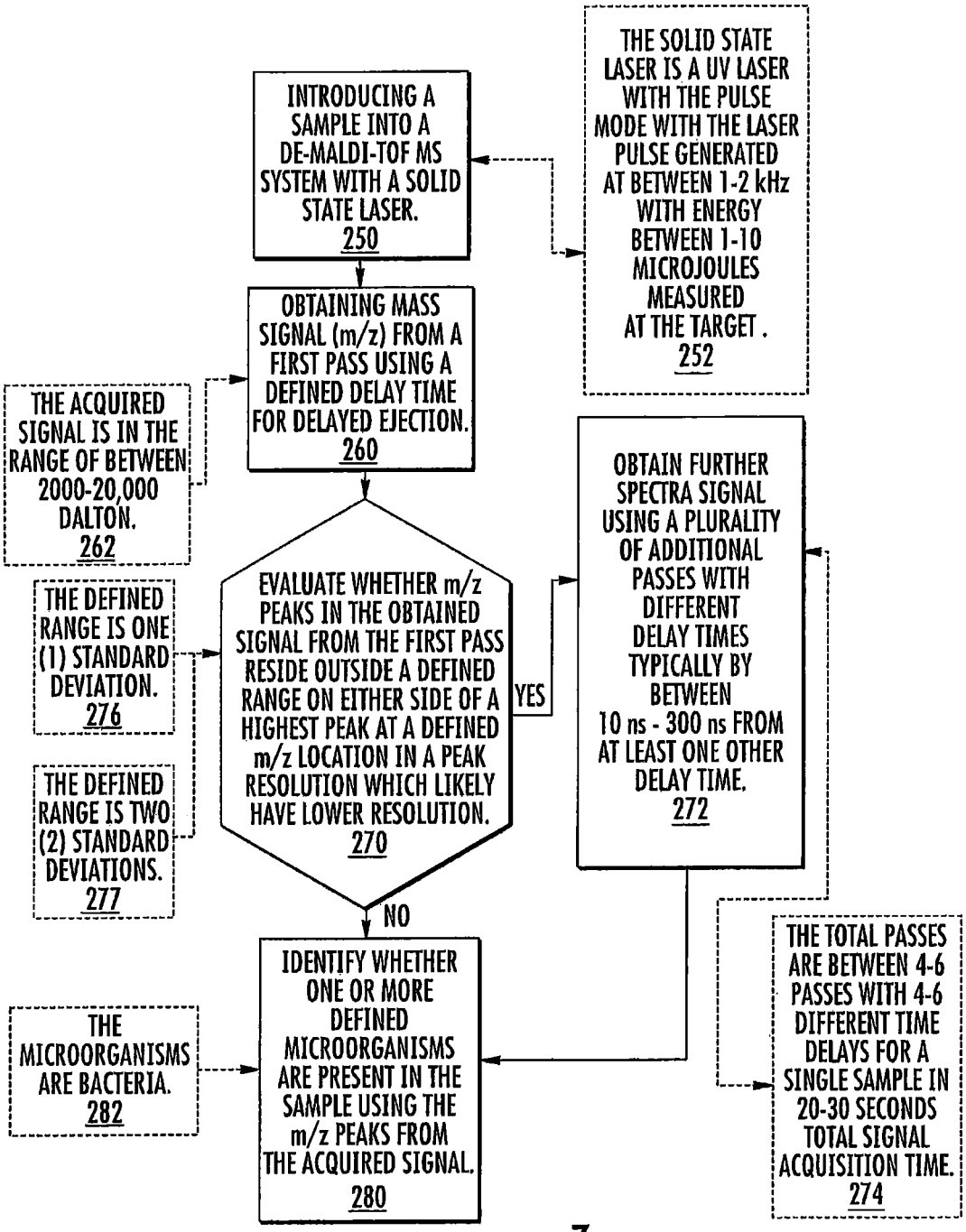
FIG. 7 is a flow chart of an adaptive protocol for determining whether and/or what delay times to use for a particular sample according to embodiments of the present invention.
Figure 8:
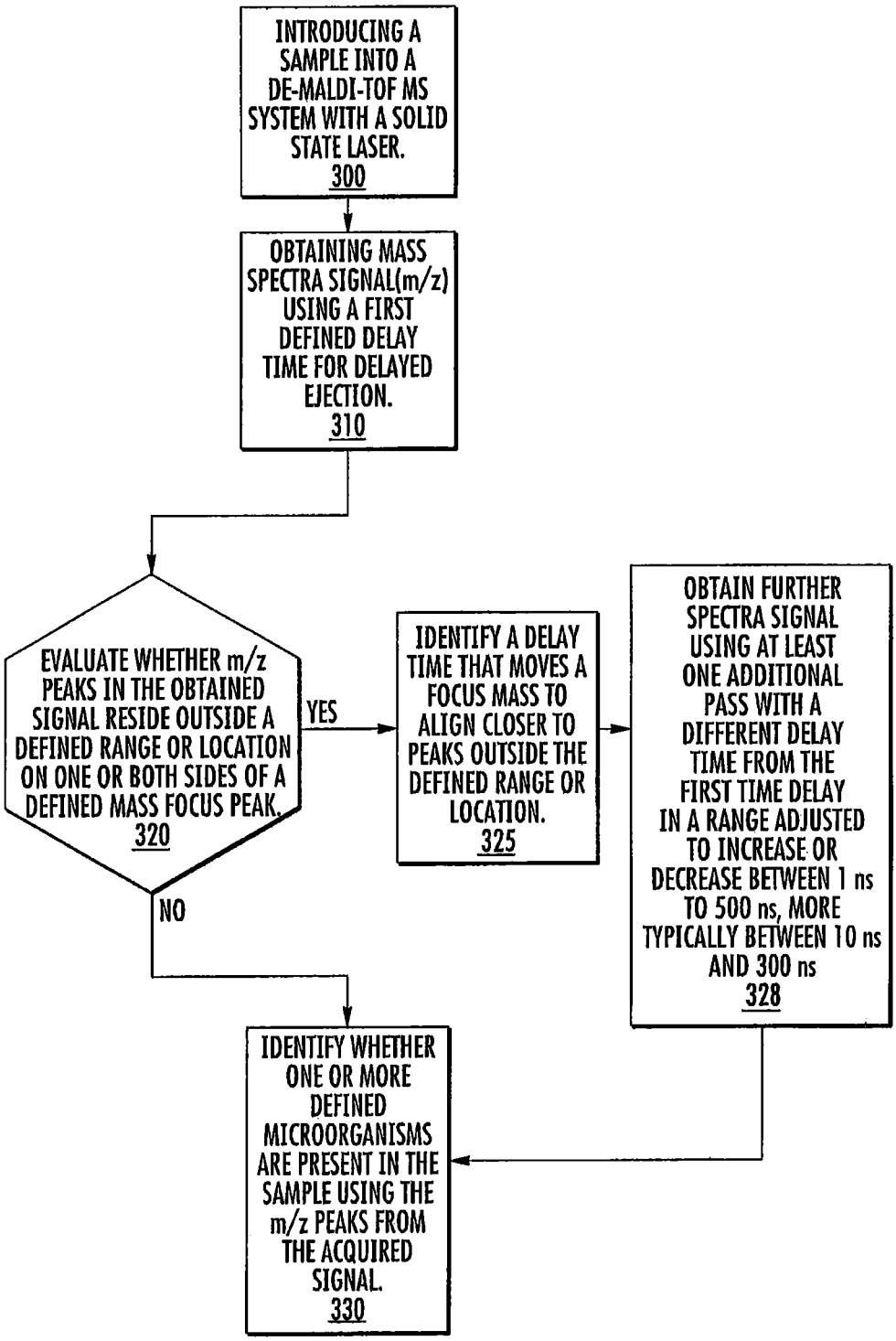
FIG. 8 is a flow chart of an adaptive protocol for determining whether and/or what delay times to use for a particular sample according to embodiments of the present invention.

FIGS. 6, 7 and 8 illustrate exemplary operations that can be used to carry out methods according to embodiments of the present invention. FIG. 6 is a "brute" strength version which can be configured to operate with a defined sequence of time intervals for most or all samples or at least samples of the same type. FIGS. 7 and 8 illustrate adaptive versions of the time delay protocol that can consider the signal data obtained then modify the acquisition protocol automatically to select one or more additional delay times based on that analysis so as to be able to customize a time delay for each sample or at least decide a series of delay times based on a first pass of data using a defined time delay.

Referring first to FIG. 6, a sample for analysis is introduced into a MALDI-TOF MS system with a TOF flight tube and solid state laser (block 200). Laser pulses used with delayed extraction voltage pulses with varying time delay (e.g., different delayed extraction times "td2" and corresponding "td3", FIG. 2C) are successively applied during analysis of a respective single sample to obtain mass spectra (block 210). Spectra of the single sample from the different delay times are obtained (block 220). A substance (e.g., constituent, biomolecule, microorganism) in the sample is identified based on the obtained spectra (block 230).

The laser can output a laser pulse with between about 1-10 microjoules of energy (measured at the target) (block 203).

The laser pulse width can be between about 3-5 ns (block 204).

The TOF flight tube length can optionally be between about 0.4 m and about 1.0 m (block 205). However, longer or shorter flight tubes may be used in some embodiments.

The MS system can optionally be a table top unit with TOF flight tube length about 0.8 m (block 207).

Multiple signal acquisitions can be taken using varying delay times for generating spectra of a single sample in between about 20-30 seconds (block 215).

The sample can comprise a biosample from a patient and the identifying step can be carried out to identify if there is a defined microorganism such as bacteria in the sample for medical evaluation of the patient (block 235).

The analysis can identify whether any of about 150 (or more) different defined species of bacteria is in a respective sample based on the obtained spectra (block 236).

The solid state laser can be a UV solid state laser with a wavelength that is above about 320 nm, typically between about 347 nm to about 360 nm (block 202).

The delay times can vary between successive laser pulses or between one or more of the different laser pulses of a single sample by between about 1 ns to about 300 ns, and the total delay time for delayed extraction for a respective laser pulse is typically between 10 ns and 2500 ns (block 212).

The target mass range can be between about 2,000-20,000 Daltons (block 221).

The number of delay times can be between about 2-10, typically between 2-6 different delay times with a total cumulative signal acquisition time of between about 20-30 seconds, such as 2, 3, 4, 5 or 6 different delay times, for a single sample to thereby provide good resolution of the obtained spectra over the entire range (block 222).

The spectra can have a resolution, Δm, as low as 3.2 over a target range of 3-20 kDa and/or a resolution that is substantially the same as the peak resolution of a focus mass at a single mass weight. This is based on the theoretical minimum peak separation, Δm, in the range of 3-20 kDa. The spectra can have a resolution Δm, as low as 3.2, typically between 50 Da and 3.2 Da, over a target range of 3-20 kDa and/or a resolution that is substantially the same as the peak resolution of a focus mass at a single mass weight (block 233).

TOF systems do not operate based on a constant resolution over the m/z scale. See *Introduction to Mass Spectrometry* by Watson and Sparkman. It is important to note that lower resolution is better and "high resolution mass spectrometry" typically refers to maximizing resolving power. Actual measured Δm values in prototype systems using some td2 delay sequences were closer to 30 Da at an exemplary desired focus mass of 8 kDa.

Referring now to FIG. 7, again, a sample is introduced into a MALDI-TOF MS system with a solid state laser (block 250). Mass signal (m/z) is obtained from a first pass using a defined time delay for delayed ejection (block 260). The system electronically evaluates whether m/z peaks in the obtained spectrum from the first pass reside outside a defined range on either side of a defined focus mass and/or a defined m/z location which likely have lower resolution than the focus mass (block 270). If no, then the system can electronically identify whether one or more defined microorganisms are present in the sample using the m/z peaks from the acquired signal (block 280). If yes, further spectra signal can be obtained using at least one additional pass with a different time delay from the first pass changed by between 10 ns to 300 ns (block 272).

The total passes can be, in some embodiments, between 4-6 passes with 4-6 different delay times in a range of 1 ns-2500 ns, with different time delays being increased or decreased by between 1 ns to 500 ns for a single sample (more typically between about 10 ns and 400 ns, such as 100 ns, 200 ns, 300 ns and 400 ns). The different delay times can be used for accumulating signal in less than 30 seconds for a respective sample, typically in 20-30 seconds total signal acquisition time (block 274).

The different delay times can be progressively increasing delay times that can increase or decrease by between 1 ns to 500 ns for a single sample in 20-30 seconds total signal acquisition time.

The different delay times can be progressively decreasing delay times can increase or decrease between 1 ns to 500 ns for a single sample in 20-30 seconds total signal acquisition time.

The acquired signal can be in the range of between 2,000-20,000 Dalton (block 262).

The defined range is one (1) standard deviation from the defined focus mass (block 276).

The defined range is two (2) standard deviations from the defined focus mass (block 277).

The microorganisms can be bacteria (block 282).

The solid state laser can be a UV laser with the laser pulse having an energy between about 1-10 microjoules (measured at the target) and the laser can have a repetition rate between 1 kHz to 2 kHz or more (block 252) (e.g., typically under 10k Hz).

Referring to FIG. 8, a sample is introduced into a DE-MALDI-TOF MS system with a solid state laser (block 300). Mass spectra signal (m/z) is obtained using a first defined time delay for delayed ejection (block 310). The m/z peaks in the obtained signal are electronically evaluated to determine whether any target peaks or peaks of interest might reside outside a defined range or location on one or both sides of a defined mass focus peak (block 320). If no, the first pass signal is sufficient to identify if one or more defined microorganisms are present in the sample using the m/z peaks from the acquired signal (block 330). If yes, a time delay that moves a focus mass to align closer to peaks outside the defined range or location is electronically selected and/or identified (block 325). Further spectra signal is obtained using at least one additional pass with a different time delay from the first time delay (adjusted to increase or decrease) from another (at least one other) delay time by an amount in a range between 1 ns to 500 ns, typically between 10 ns and 400 ns or 10 ns and 300 ns, based on the identified time delay (block 328). The composite signal can be evaluated (block 330).

As will be appreciated by one of skill in the art, embodiments of the invention may be embodied as a method, system, data processing system, or computer program product. Furthermore, the present invention may take the form of a computer program product on a non-transient computer usable storage medium having computer usable program code embodied in the medium. Any suitable computer readable medium may be utilized including hard disks, CD-ROMs, optical storage devices, a transmission media such as those supporting the Internet or an intranet, or magnetic or other electronic storage devices.

Computer program code for carrying out operations of the present invention may be written in an object oriented programming language such as Java, Smalltalk, C # or C++. However, the computer program code for carrying out operations of the present invention may also be written in conventional procedural programming languages, such as the "C" programming language or in a visually oriented programming environment, such as Visual Basic.

Certain of the program code may execute entirely on one or more of a user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider). Typically, some program code executes on at least one web (hub) server and some may execute on at least one web client and with communication between the server(s) and clients using the Internet.

The invention is described in part below with reference to flowchart illustrations and/or block diagrams of methods, systems, computer program products and data and/or system architecture structures according to embodiments of the invention. It will be understood that each block of the illustrations, and/or combinations of blocks, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the block or blocks.

These computer program instructions may also be stored in a computer-readable memory or storage that can direct a computer or other programmable data processing apparatus to function in a particular manner, such that the instructions stored in the computer-readable memory or storage produce an article of manufacture including instruction means which implement the function/act specified in the block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowcharts and block diagrams of certain of the figures herein illustrate exemplary architecture, functionality, and operation of possible implementations of embodiments of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order or two or more blocks may be combined, depending upon the functionality involved.

Figure 9:
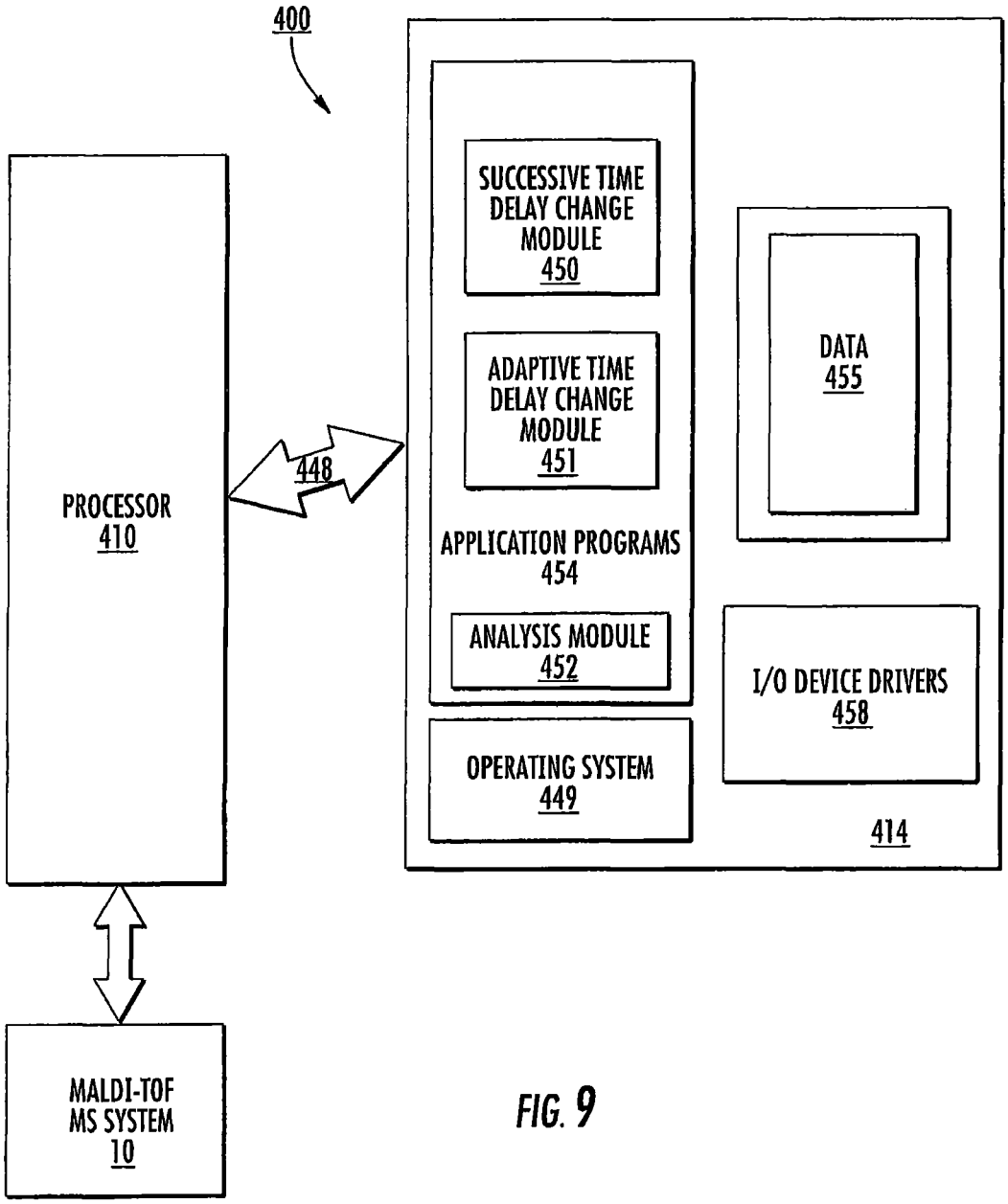
FIG. 9 is a block diagram of a data processing system according to embodiments of the present invention.

FIG. 9 is a schematic illustration of a circuit or data processing system 400 that provides the delay time change module 15 and/or the analysis 40 for the MALDI-MS TOF system 10. The circuits and/or data processing systems 400 may be incorporated in a digital signal processor in any suitable device or devices. As shown in FIG. 9, the processor 410 communicates with and/or is integral with clients or local user devices and/or with memory 414 via an address/data bus 448. The processor 410 can be any commercially available or custom microprocessor. The memory 414 is representative of the overall hierarchy of memory devices containing the software and data used to implement the functionality of the data processing system. The memory 414 can include, but is not limited to, the following types of devices: cache, ROM, PROM, EPROM, EEPROM, flash memory, SRAM, and DRAM.

FIG. 9 illustrates that the memory 414 may include several categories of software and data used in the data processing system: the operating system 449; the application programs 454; the input/output (I/O) device drivers 458; and data 455. The data 455 can include time delay sequences and/or a library of sample identification correlated to m/z identification patterns.

As will be appreciated by those of skill in the art, the operating systems 449 may be any operating system suitable for use with a data processing system, such as OS/2, AIX, or zOS from International Business Machines Corporation, Armonk, N.Y., Windows CE, Windows NT, Windows95, Windows98, Windows2000, Windows XP, Windows Vista, Windows 7, Windows CE or other Windows versions from Microsoft Corporation, Redmond, Wash., Palm OS, Symbian OS, Cisco IOS, VxWorks, Unix or Linux, Mac OS from Apple Computer, LabView, or proprietary operating systems.

The I/O device drivers 458 typically include software routines accessed through the operating system 449 by the application programs 454 to communicate with devices such as I/O data port(s), data storage 455 and certain memory 414 components. The application programs 455 are illustrative of the programs that implement the various features of the data processing system and can include at least one application, which supports operations according to embodiments of the present invention. Finally, the data 455 represent the static and dynamic data used by the application programs 454, the operating system 449, the I/O device drivers 458, and other software programs that may reside in the memory 414.

While the present invention is illustrated, for example, with reference to the Successive Time Delay Module 450, the Adaptive Time Delay Module 451 and the Analysis Module 452 being application programs in FIG. 9, as will be appreciated by those of skill in the art, other configurations may also be utilized while still benefiting from the teachings of the present invention. For example, the Modules and/or may also be incorporated into the operating system 449, the I/O device drivers 458 or other such logical division of the data processing system. Thus, the present invention should not be construed as limited to the configuration of FIG. 9 which is intended to encompass any configuration capable of carrying out the operations described herein. Further, one or more of modules, i.e., Modules 450, 451, 452 can communicate with or be incorporated totally or partially in other components, such as separate or a single processor.

The I/O data port can be used to transfer information between the data processing system and another computer system or a network (e.g., the Internet) or to other devices controlled by the processor. These components may be conventional components such as those used in many conventional data processing systems, which may be configured in accordance with the present invention to operate as described herein.

The system 10 can include a patient record database and/or server that can include electronic medical records (EMR) with privacy access restrictions that are in compliance with HIPPA rules due to the client-server operation and privilege defined access for different users.

Having now described embodiments of the invention, the same will be illustrated with reference to certain examples, which are included herein for illustration purposes only, and which are not intended to be limiting of the invention.

EXAMPLES

Figure 10A:
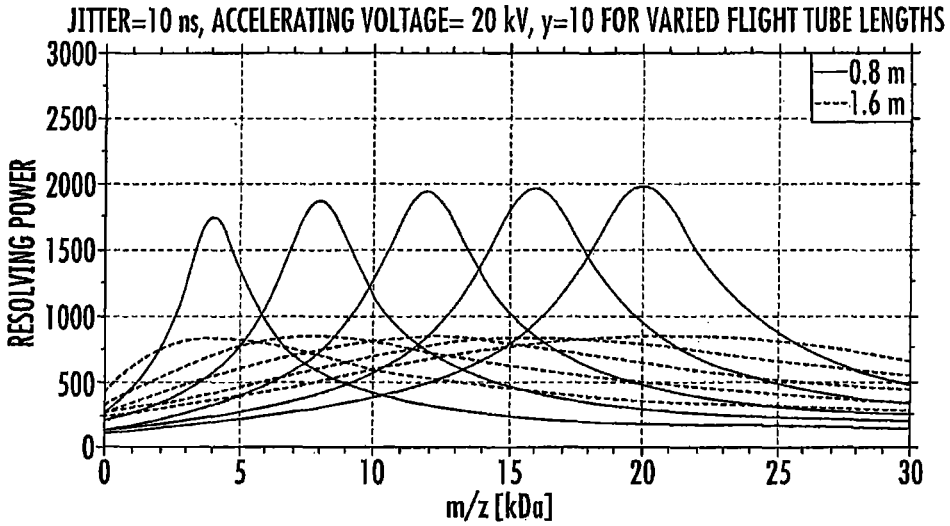
FIG. 10A is a graph of calculated resolving power for different focus masses and different length flight tubes.
Figure 10B:
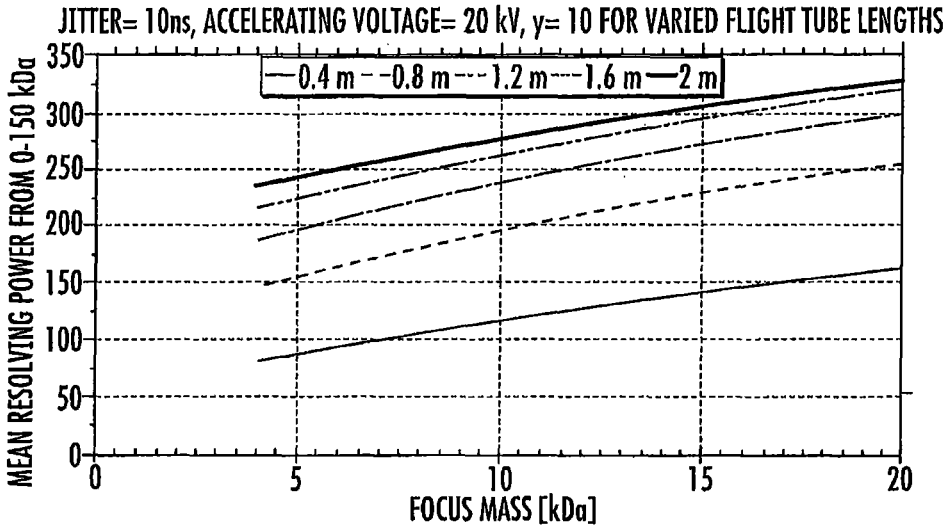
FIG. 10B is a graph of focus mass (kDa) versus calculated mean resolving power for different flight tube lengths.

FIG. 10A is a graph of calculated resolving power for different focus masses and different length flight tubes. FIG. 10B is a graph of focus mass (kDa) versus calculated mean resolving power for different flight tube lengths.

Figure 11:
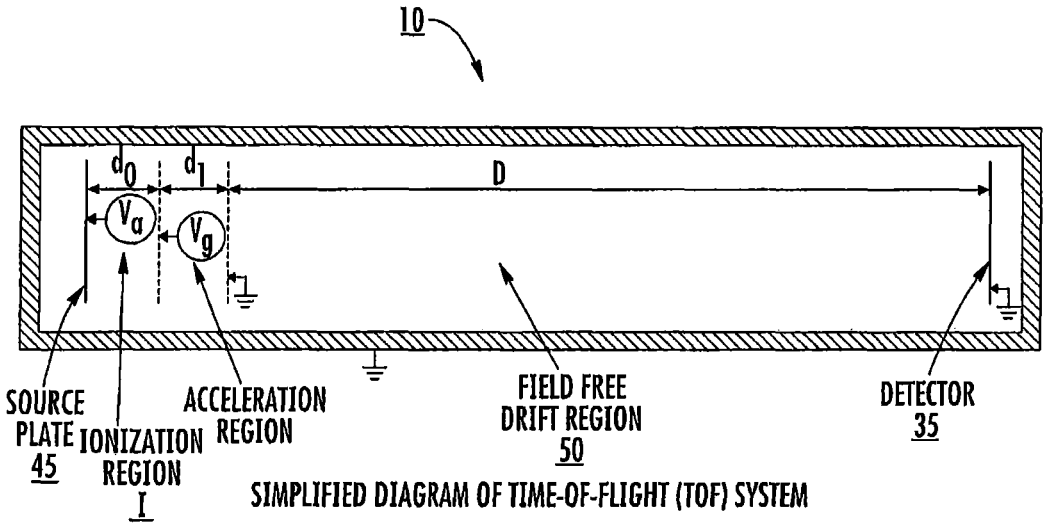
FIG. 11 is a schematic diagram of a DE-MALDI-TOF system. The assumptions and equations in the EXAMPLES section describe mathematical equations and terms that were used to calculate the resolving power in FIGS. 10A/10B.

FIG. 11 is a schematic diagram of a TOF system. Theoretically calculated mean resolving power is higher for the 1.6 m flight tube but makes the footprint of the MS system larger than desired for most table top applications. It is contemplated that the variable extractions to vary the focus mass for a given accelerating voltage and extraction voltage as described above may provide a way to take advantage of higher peak resolving powers for a shorter flight tube, such as, by way of example only, a 0.8 m length flight tube.

The following equations/assumptions can be used to describe theoretical operation of an MS system for calculating resolving power such as shown in FIGS. 10A/10B.

$d_o$=5 mm $d_1$=10 mm y=10

$V_a$=20 kV $\delta x$=0.025 mm $\delta v_o=5\times10^4$ mm/ns $\delta t$=4 ns $c_1=1.38914\times10^{-2}$ (for v in mm/ns, m in Da, t in ns, and din mm)

All particles are singly ionized

Higher order terms are neglected for resolution effects due initial position and velocity distributions $D_e \approx D$ $D_v \approx D$ Fringe and penetrating electric field effects are neglected Equations The following equations can be used to calculate the theoretical resolving power based on the variables listed in Table 2. The ratio, y, can be used to adjust the "focal lengths," $D_v$ and $D_s$ of the ion beam (see, S. R. Weinberger, E. P. Donlon, Y. Kaplun, T. C. Anderson, L. Li, L. Russon, and R. Whittal, "Devices for time lag focusing time-of-flight mass spectrometry," U.S. Pat. No. 5,777,325 A, 7 Jul. 1998, and K. M. Hayden, M. Vestal, and J. M. Campbell, "Ion sources for mass spectrometry," U.S. Pat. No. 7,176,454 B2, 13 Feb. 2007, the contents of which are hereby incorporated by reference as if recited in full herein).

"Focal lengths" refer to temporal focusing, not spatial focusing $$y = \frac{V_a}{V_a - V_g} \rightarrow V_g = V_a - \frac{V_a}{y}$$

$$D_v = D_s + \frac{(2d_o y)^2}{v_n^* \Delta t}$$

The ion velocity can be expressed based on Newtonian physics (see S. R. Weinberger, E. P. Donlon, Y. Kaplun, T. C. Anderson, L. Li, L. Russon, and R. Whittal, "Devices for time lag focusing time-of-flight mass spectrometry," U.S.

Pat. No. 5,777,325 A, 7 Jul. 1998, the contents of which are hereby incorporated by reference as if recited in full herein).

$$v_n^* = c_1\left(\frac{V_a}{m^*}\right)^{1/2}$$

$$v = c_1\left(\frac{V_a}{m}\right)^{1/2}$$

$$\Delta D = D_v - D_s$$

$$K = \frac{2d_o y}{\Delta D}$$

The delay between ionization and application of extraction pulse can be shown as Δt (see M. Vestal and K. Hayden, "High performance MALDI-TOF mass spectrometry for proteomics," International Journal of Mass Spectrometry, vol. 268, no. 2, pp. 83-92, 2007, the contents of which are hereby incorporated by reference as if recited in full herein).

$$\Delta t = \left(\frac{2d_o yK}{c_1}\right)\left(\frac{m}{V_a}\right)^{1/2}$$

The $R_{xx}$ values can be the individual contributing factors to the overall resolution (see M. Vestal and K. Hayden, "High performance MALDI-TOF mass spectrometry for proteomics," International Journal of Mass Spectrometry, vol. 268, no. 2, pp. 83-92, 2007, and F. H. Laukien and M. A. Park, "Kinetic energy focusing for pulsed ion desorption mass spectrometry," U.S. Pat. No. 6,130,426 A, 10 Oct. 2000, the contents of which are hereby incorporated by reference as if recited in full herein).

$$R_{s1} = \left(\frac{\Delta D}{D_e}\right)\left(\frac{\delta x}{d_o y}\right)$$

$$R_{v1} = \left(\frac{4d_o y}{D_e}\right)\left(\frac{\delta v_o}{v}\right)$$

$$R_m = R_{v1}\left[1 - \left(\frac{m}{m^*}\right)^{1/2}\right]$$

$$R_t = \frac{2v\delta t}{D_e}$$

$$R_\Delta = 2\left(\frac{\delta_j \delta v_0}{D_e}\right)\left(\frac{\Delta D}{2d_o y}\right)^2$$

The resolution, R, is the quadrature sum of the individual contributing factors (see K. M. Hayden, M. Vestal, and J. M. Campbell, "Ion sources for mass spectrometry," U.S. Pat. No. 7,176,454 B2, 13 Feb. 2007, the contents of which are hereby incorporated by reference as if recited in full herein).

The resolving power is defined as $R^{-1}$ $$R^{-1}=[R_{s1}^2+R_{v1}^2+{}_t^2+R_\Delta^2]^{-1/2}$$

TABLE 2

List of symbols used for calculations and their descriptions

| Symbol | Units | Description |
|---|---|---|
| $d_0$ | mm | distance between source place and extraction electrode |
| $d_1$ | mm | distance between extraction electrode and acceleration electrode |
| D | mm | length of field-free drift region |

TABLE 2-continued

List of symbols used for calculations and their descriptions

| Symbol | Units | Description |
|---|---|---|
| $V_a$ | V | voltage applied to sample plate |
| $V_g$ | V | voltage applied to extraction electrode |
| y | — | ratio of total acceleration potential to extraction potential |
| $D_v$ | mm | distance in field free region required for ions of same mass and initial position (aka sample thickness) but different initial velocity to have the same time of flight |
| $D_s$ | mm | distance in field free region required for ions of same mass and initial velocity but different initial positions (aka sample thickness) to have the same time of flight |
| ΔD | mm | difference between $D_v$ and $D_s$ |
| $V_n$* | mm/ns | nominal final velocity of an ion with the focus mass, m* |
| Δt | ns | time delay between laser firing and extraction voltage applied (aka delayed extraction) |
| $c_1$ | $(C/kg)^{1/2}$ | constant to account for singly-ionized species and conversion of mass units to Daltons (can incorporate unit conversion scalar to calculate velocity in mm/ns rather than m/s) |
| m* | Da | mass at which resolving power is highest (aka focus mass) |
| m | Da | mass of an ion |
| K | — | ratio used for mathematical simplification of terms |
| δx | mm | variation in initial ion position (aka sample thickness variations) |
| $D_e$ | mm | distance required for an ion in a field free drift region to have the same time of flight as an ion in the overall system (aka equivalent distance) |
| $\delta v_o$ | mm/ns | variation in initial ion velocity due to MALDI process |
| v | mm/ns | nominal final velocity of an ion with mass, m |
| $\delta_j$ | ns | system jitter between firing of laser and application of extraction pulse |
| δt | ns | temporal uncertainty of digitizer |
| $R_{s1}$ | — | resolution component due to variations in ion initial position |
| $R_{v1}$ | — | mathematical simplification term for calculating $R_m$ |
| $R_m$ | — | resolution component due to variations in ion initial velocity |
| $R_t$ | | resolution component due to temporal uncertainty of digitizer |
| $R_\Delta$ | — | resolution component due to system jitter |
| R | — | overall system resolution |

Theoretical Delay Time Vs. Focus Mass

Figure 12:
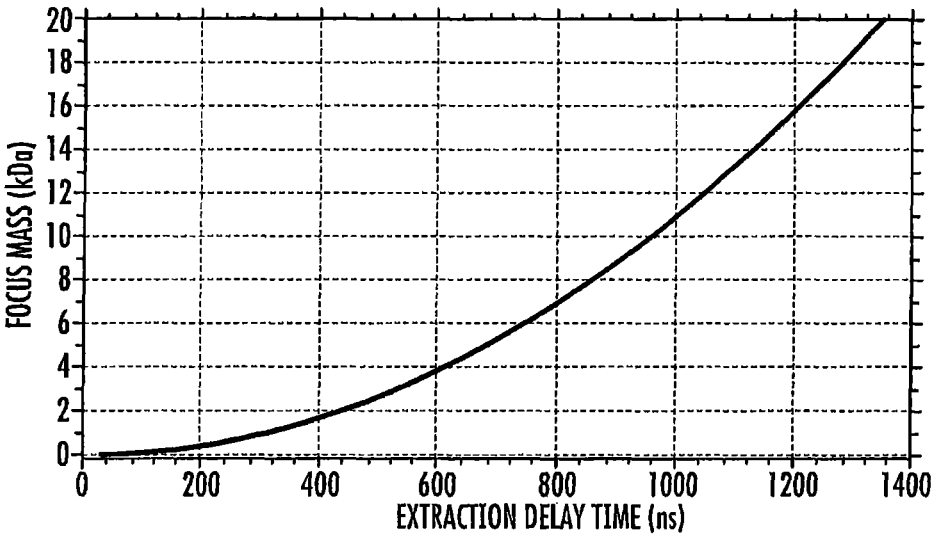
FIG. 12 is a graph of theoretical focus masses (kDa) versus extraction delay time (ns) for which resolution can be optimized for a mass spectrum for a given extraction delay time.
Figure 13:
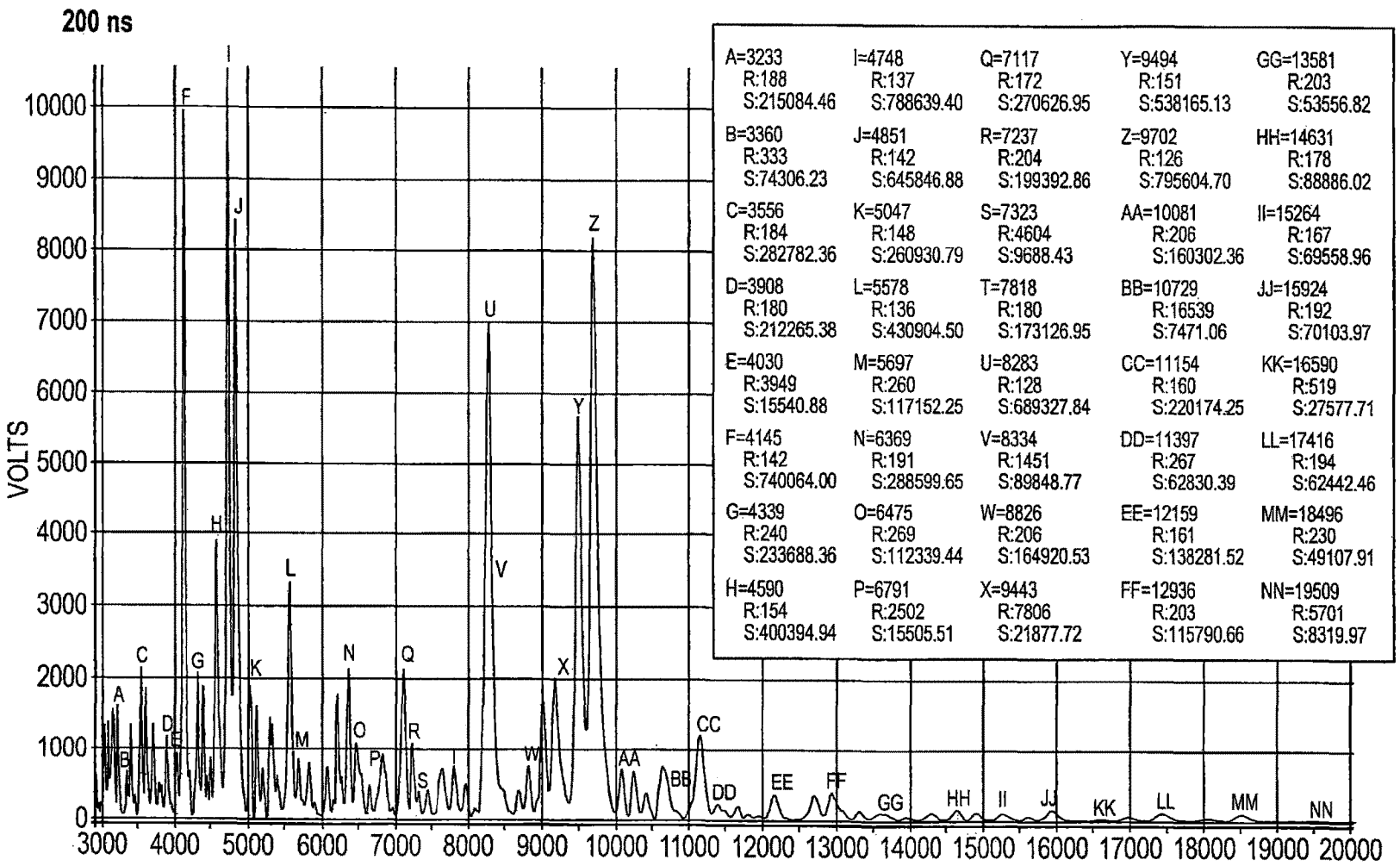
FIG. 13 is a mass spectrum generated by averaging mass spectra of 16 samples of ATCC 8739 *E. coli* with an extraction delay time of 200 ns.
Figure 14:
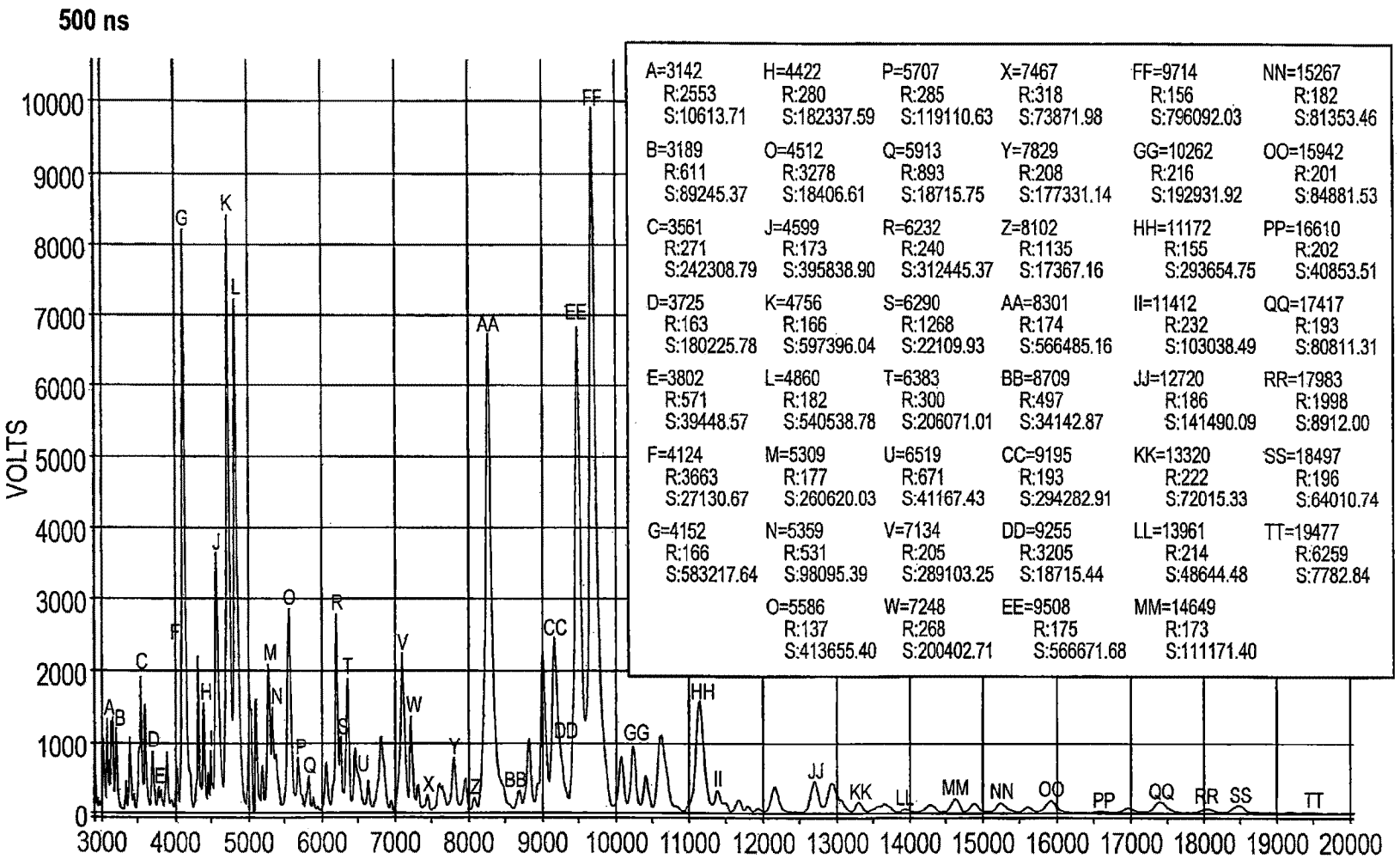
FIG. 14 is a mass spectrum generated by averaging mass spectra of 16 samples of ATCC 8739 *E. coli* with an extraction delay time of 500 ns.
Figure 15:
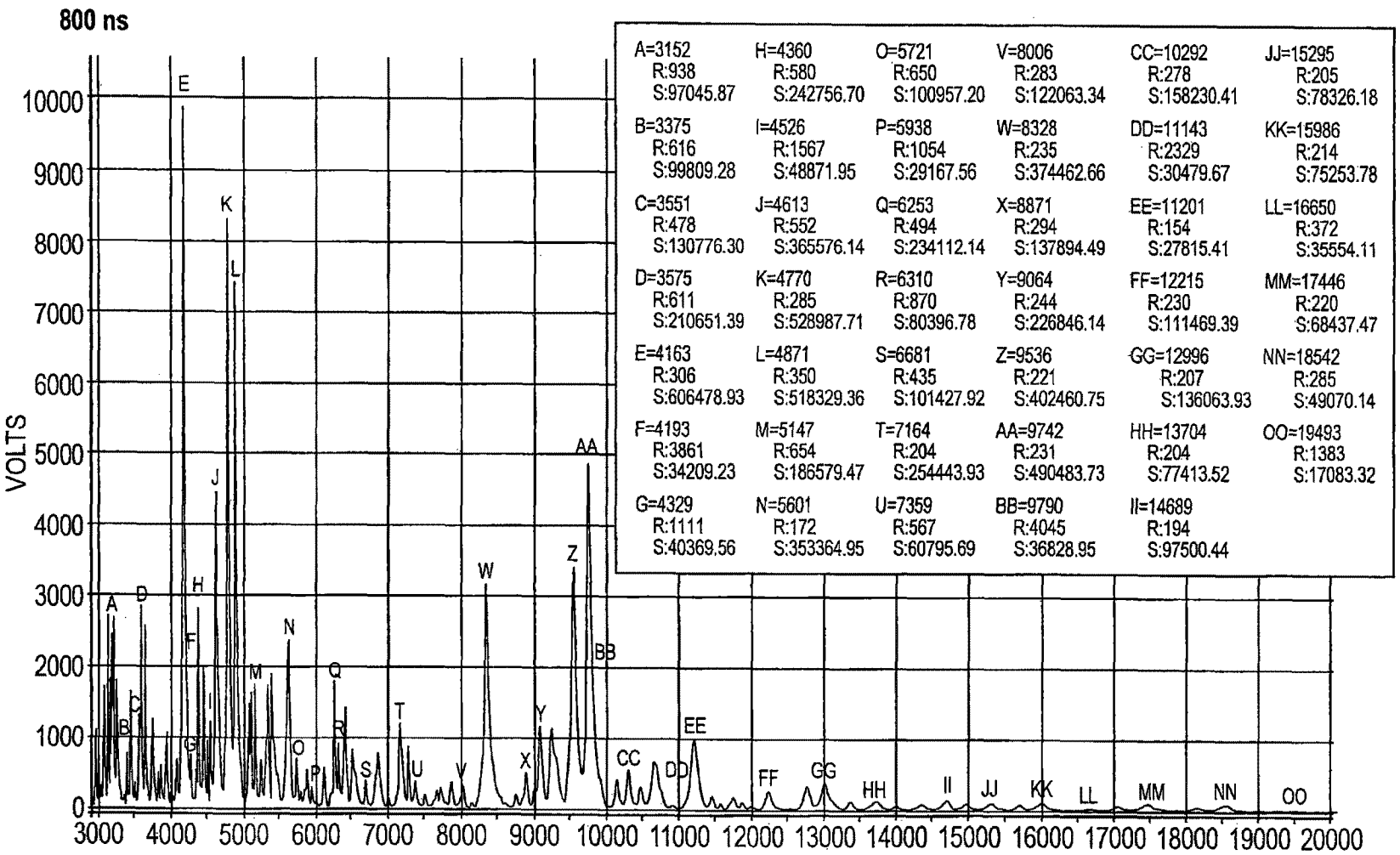
FIG. 15 is a mass spectrum generated by averaging mass spectra of 16 samples of ATCC 8739 *E. coli* with an extraction delay time of 800 ns.
Figure 16:
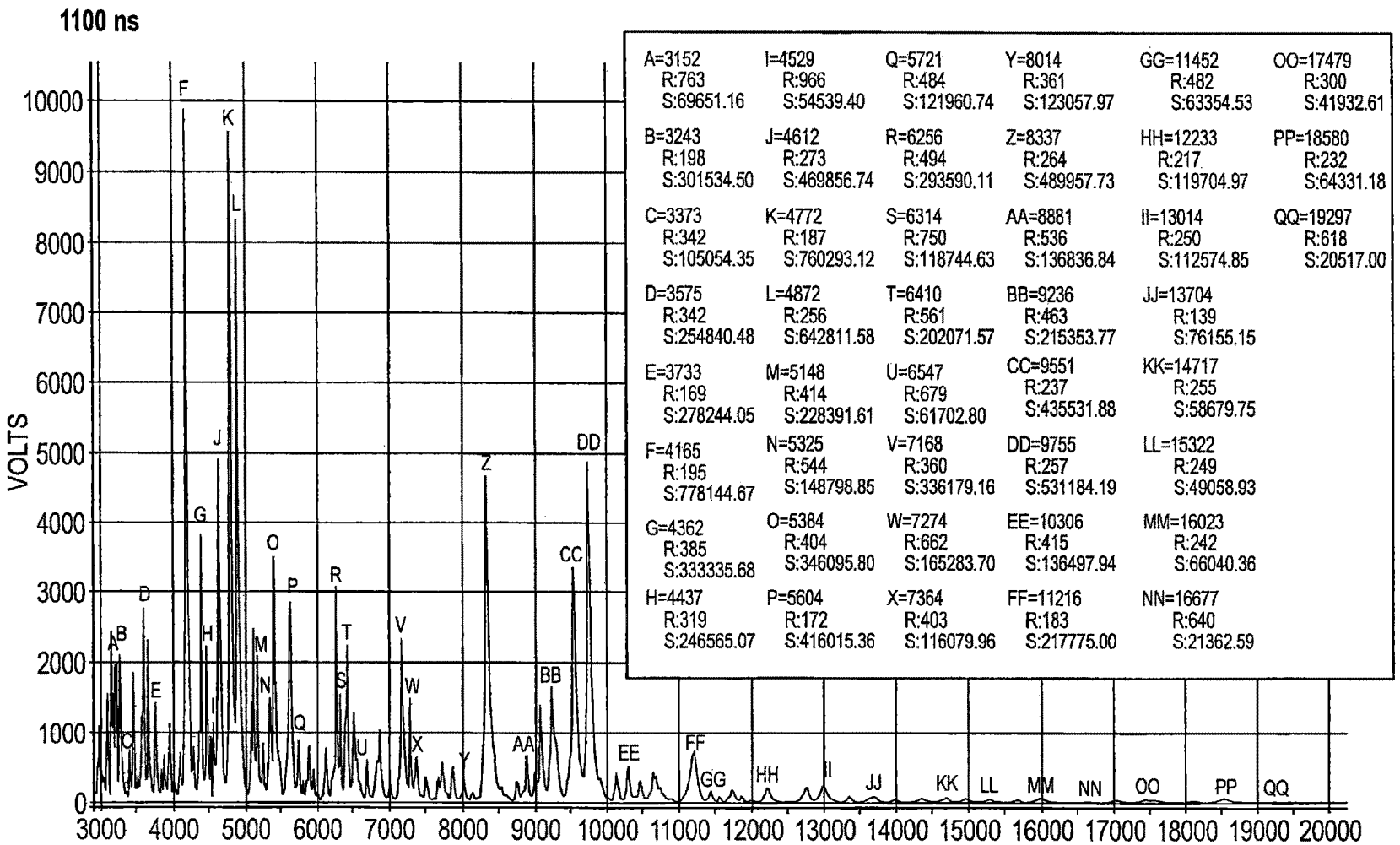
FIG. 16 is a mass spectrum generated by averaging mass spectra of 16 samples of ATCC 8739 *E. coli* with an extraction delay time of 1100 ns.
Figure 17:
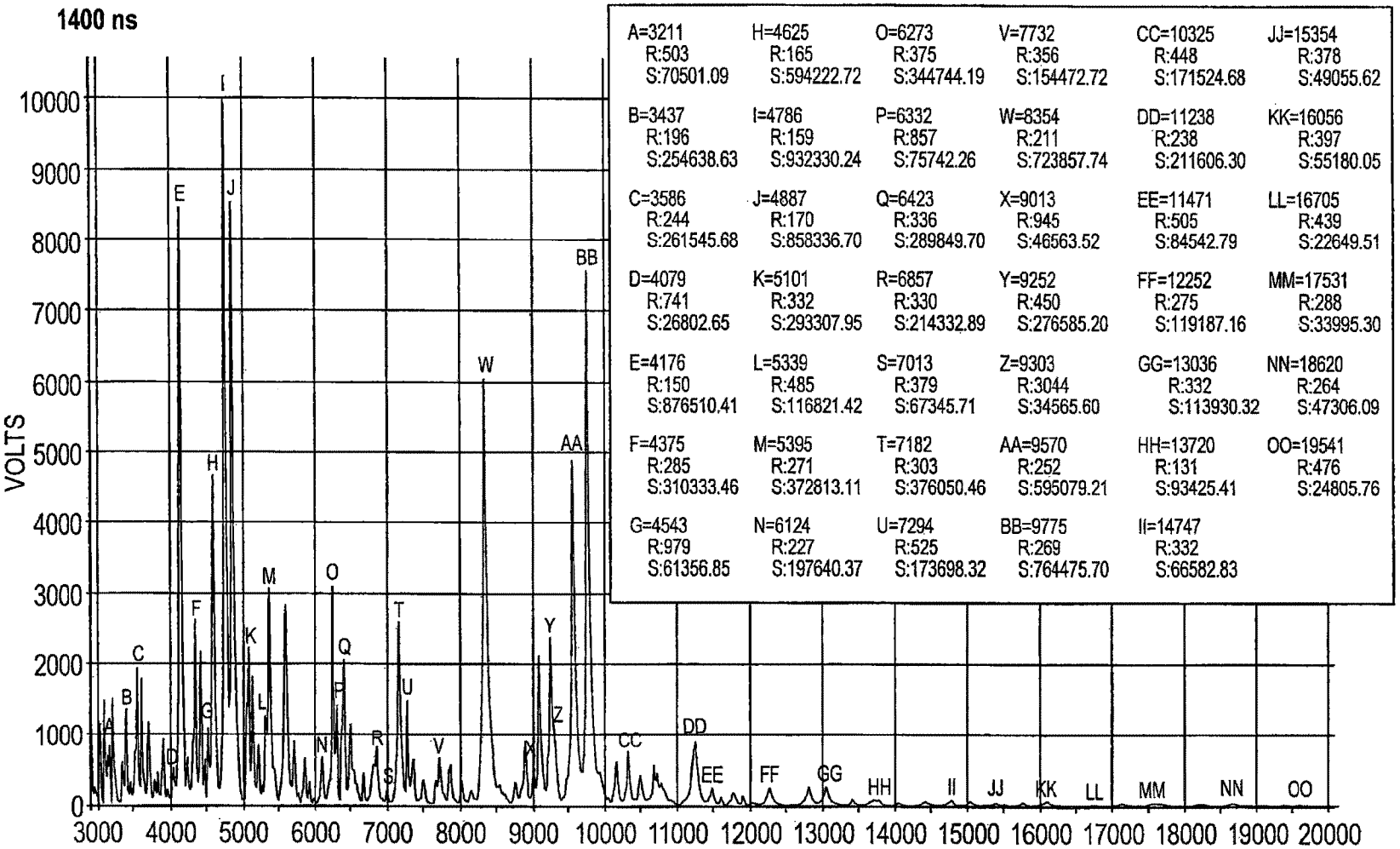
FIG. 17 is a mass spectrum generated by averaging mass spectra of 16 samples of ATCC 8739 *E. coli* with an extraction delay time of 1400 ns.
Figure 18:
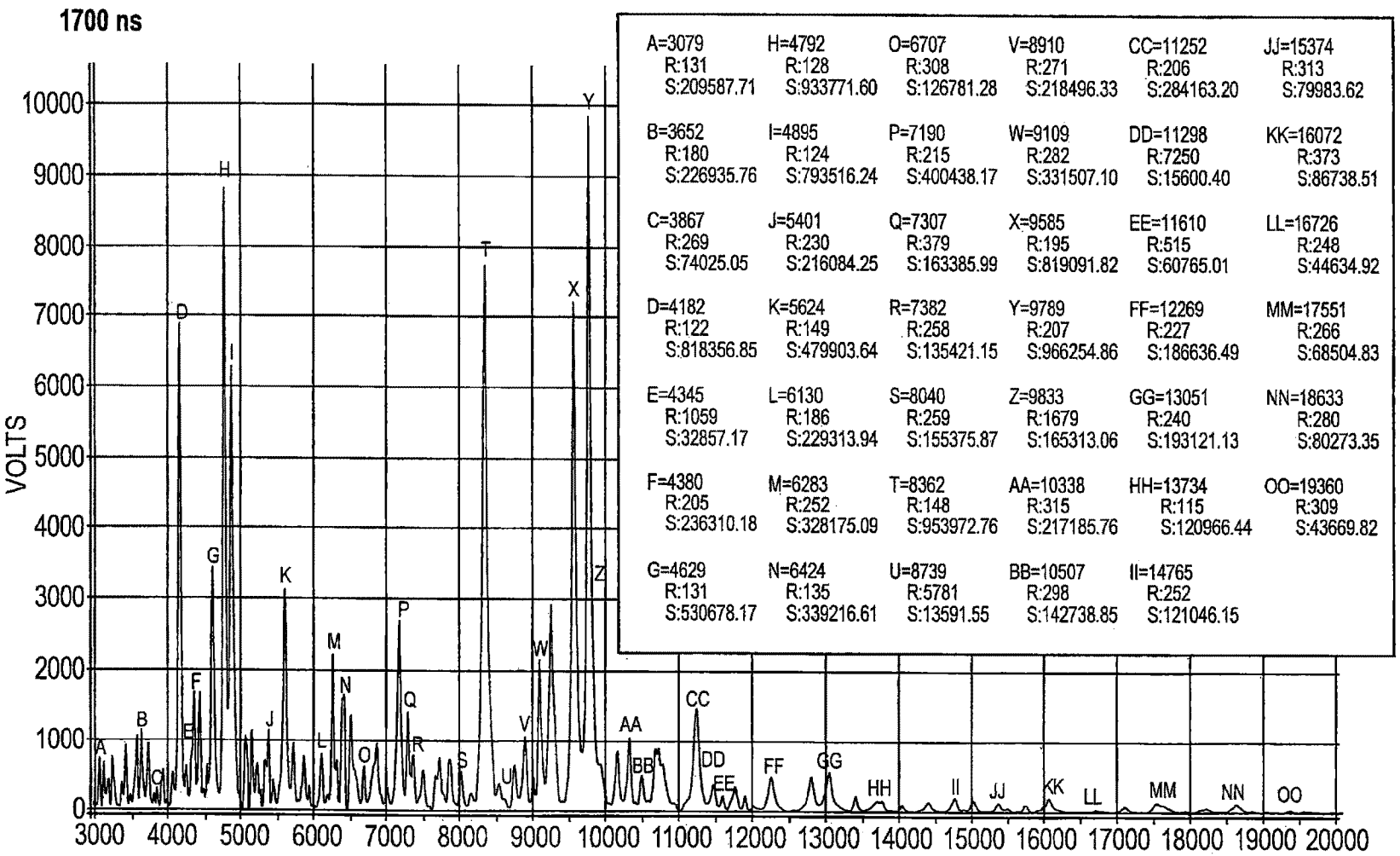
FIG. 18 is a mass spectrum generated by averaging mass spectra of 16 samples of ATCC 8739 *E. coli* with an extraction delay time of 1700 ns.
Figure 19:
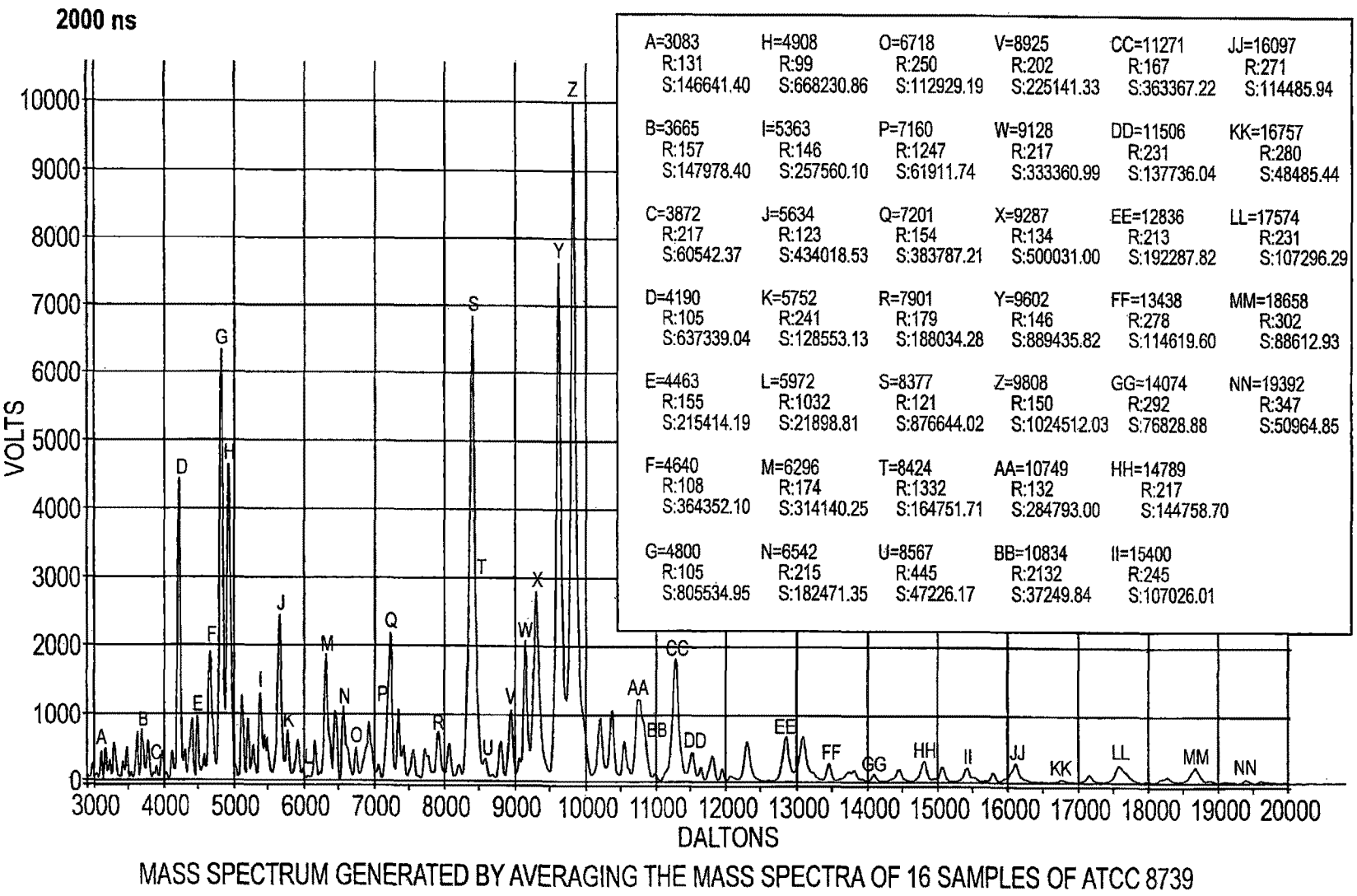
FIG. 19 is a mass spectrum generated by averaging mass spectra of 16 samples of ATCC 8739 *E. coli* with an extraction delay time of 2000 ns.
Figure 20:
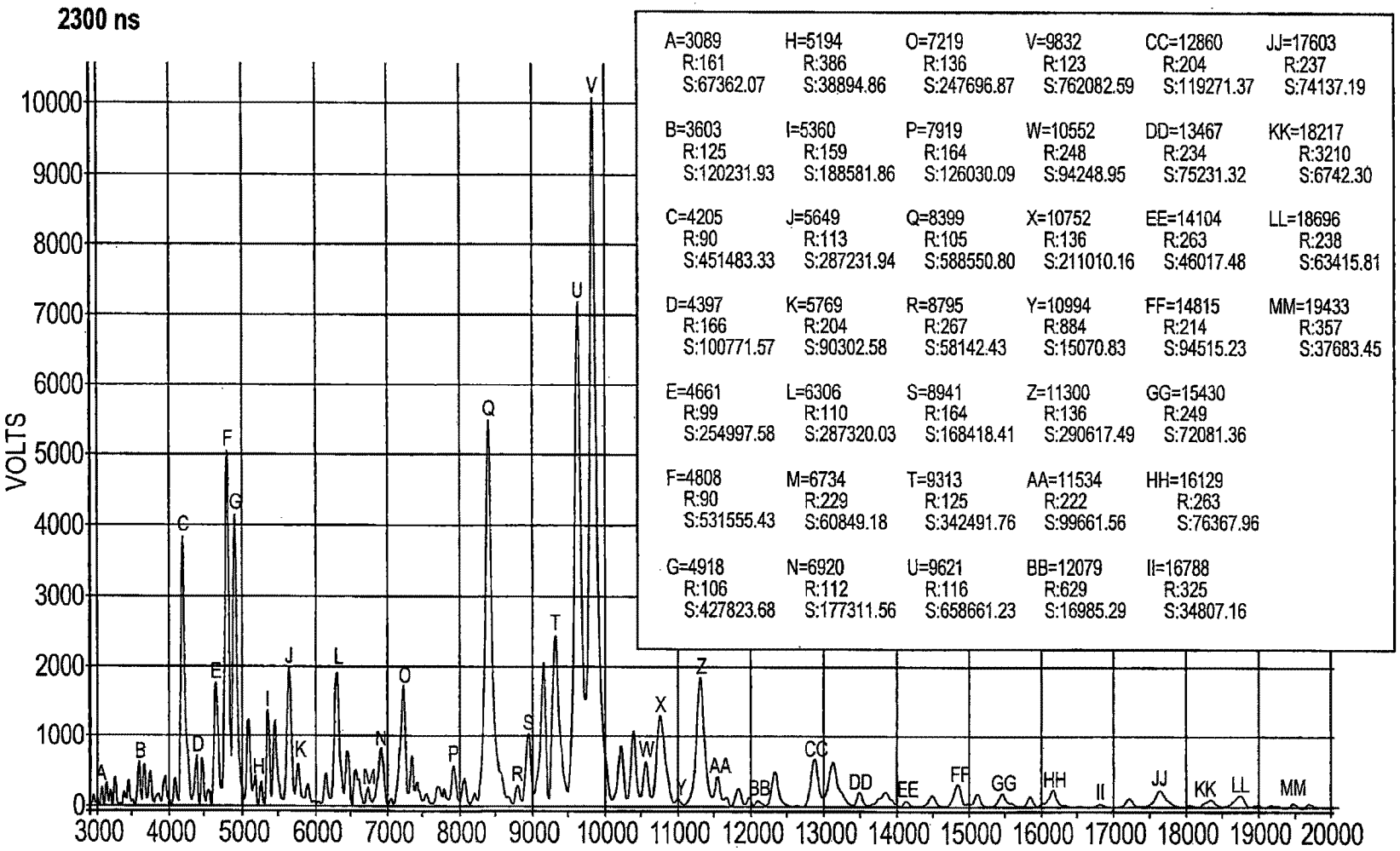
FIG. 20 is a mass spectrum generated by averaging mass spectra of 16 samples of ATCC 8739 *E. coli* with an extraction delay time of 2300 ns.

FIG. 12 shows a theoretical graph of delay time versus focus mass illustrating the mass at which the resolution is optimized for a mass spectrum for a given extraction delay time. This mass is commonly referred to as the focus mass of the instrument. In particular embodiments, the TOF MALDI systems can be commonly focused at about 8 kDa which corresponds to an extraction delay time of approximately 900 ns.

Mass spectra were acquired on different samples for different extraction delay times. Mass spectra were acquired for sixteen samples (aka spots) of ATCC 8739 *E. coli* for each extraction delay time between 200 ns and 2,300 ns. The mass spectra for the individual spots were averaged together to generate the spectra shown in FIGS. 13-20. Note that the highest resolution for peaks around 8 kDa occur for the spectra with extraction delay times of 800 ns and 1,100 ns. These two delay times bound the theoretical delay time for a focus mass of 8 kDa.

Figure 21:
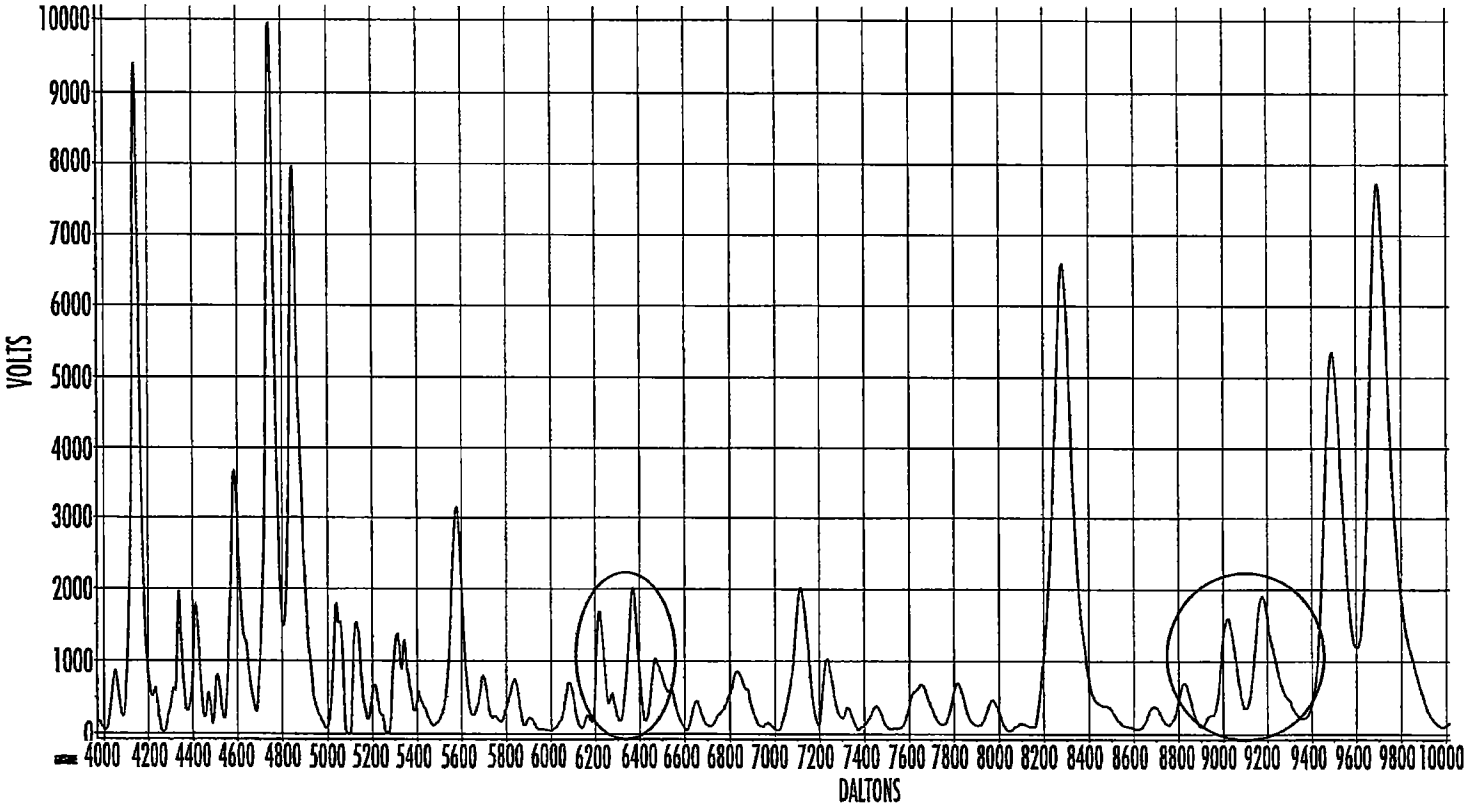
FIG. 21 is a mass spectrum generated by averaging mass spectra of 16 samples of ATCC 8739 *E. coli* with an extraction delay time of 200 ns. The mass spectrum is zoomed to 4-10 kDa and peak labels removed.
Figure 22:
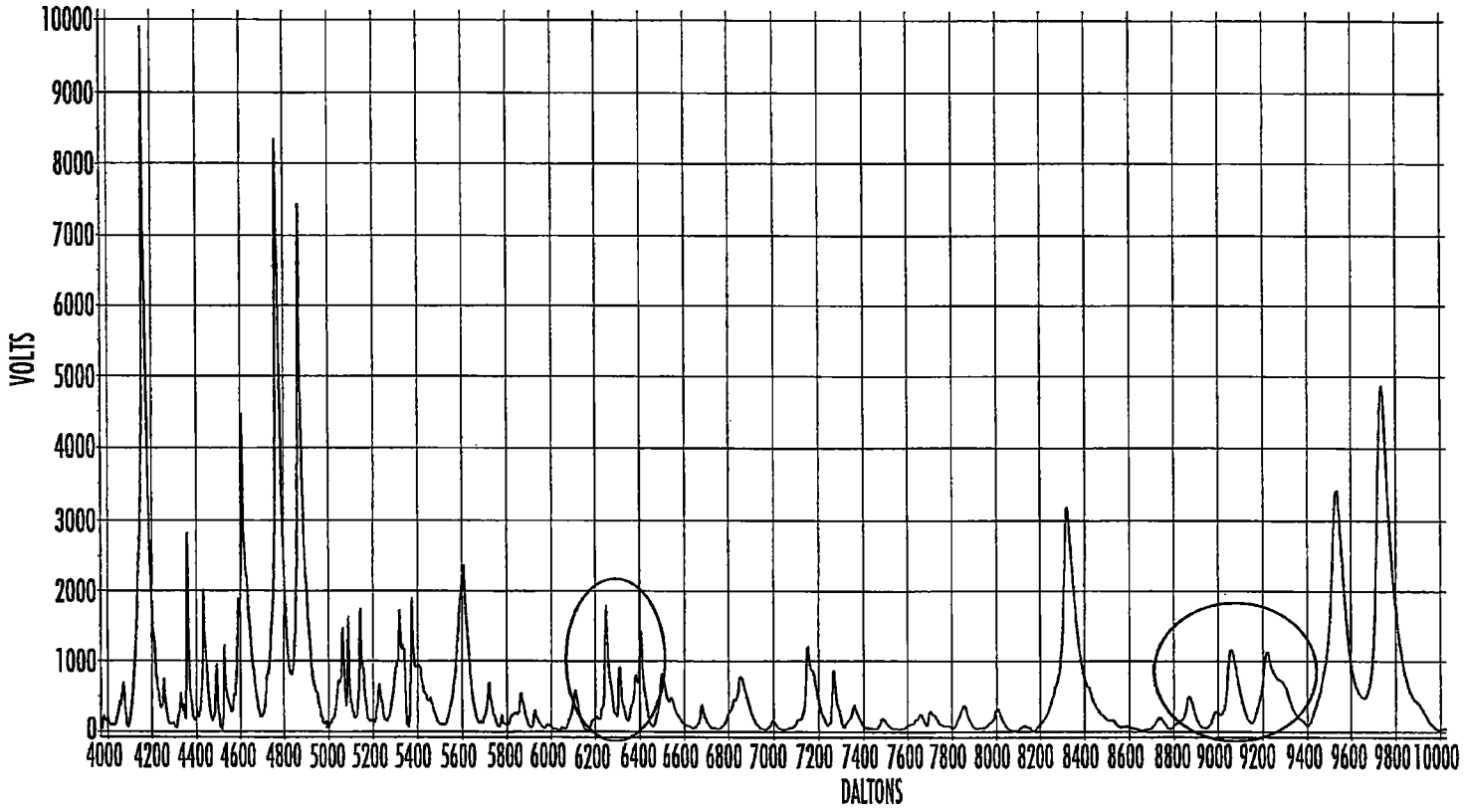
FIG. 22 is a mass spectrum generated by averaging mass spectra of 16 samples of ATCC 8739 *E. coli* with an extraction delay time of 800 ns. The mass spectrum is zoomed to 4-10 kDa and peak labels removed.
Figure 23:
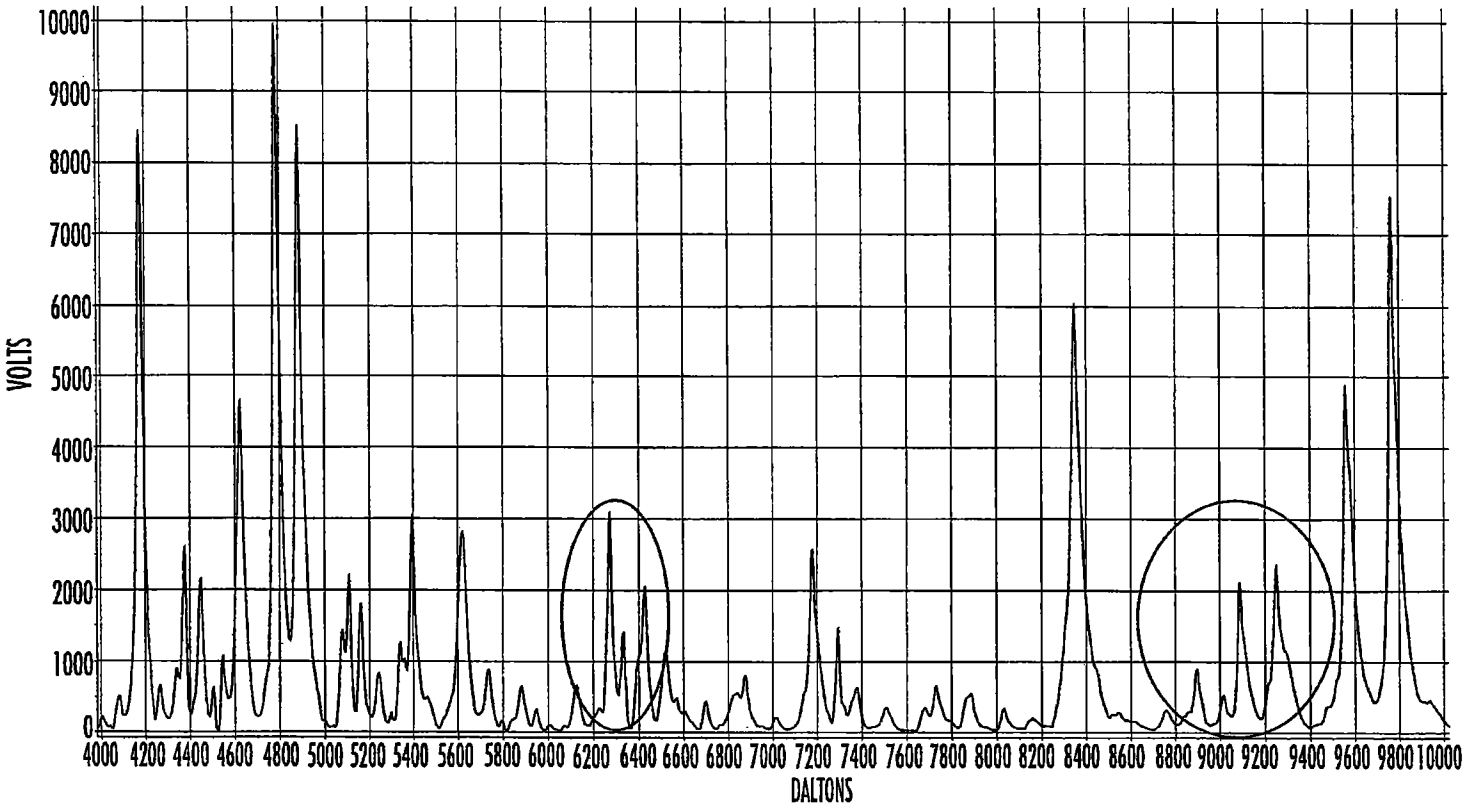
FIG. 23 is a mass spectrum generated by averaging mass spectra of 16 samples of ATCC 8739 *E. coli* with an extraction delay time of 1400 ns. The mass spectrum is zoomed to 4-10 kDa and peak labels removed.

The spectra for 200 ns, 800 ns, and 1,400 ns extraction delay times were zoomed to the 4-10 kDa range where the majority of the mass peaks reside for ATCC 8739 and are shown in FIGS. 21-23. Additionally, peak labels were removed to more easily distinguish peak features. Two mass ranges are circled for each of the spectra: 6.2-6.5 kDa and 8.0-9.4 kDa. These regions highlight the ability of different extraction delay times to resolve peaks in different mass ranges. The shorter extraction delay times should be able to better resolve peaks in lower mass ranges while longer delay times should be able to better resolve peaks in the higher mass ranges.

Figure 24:
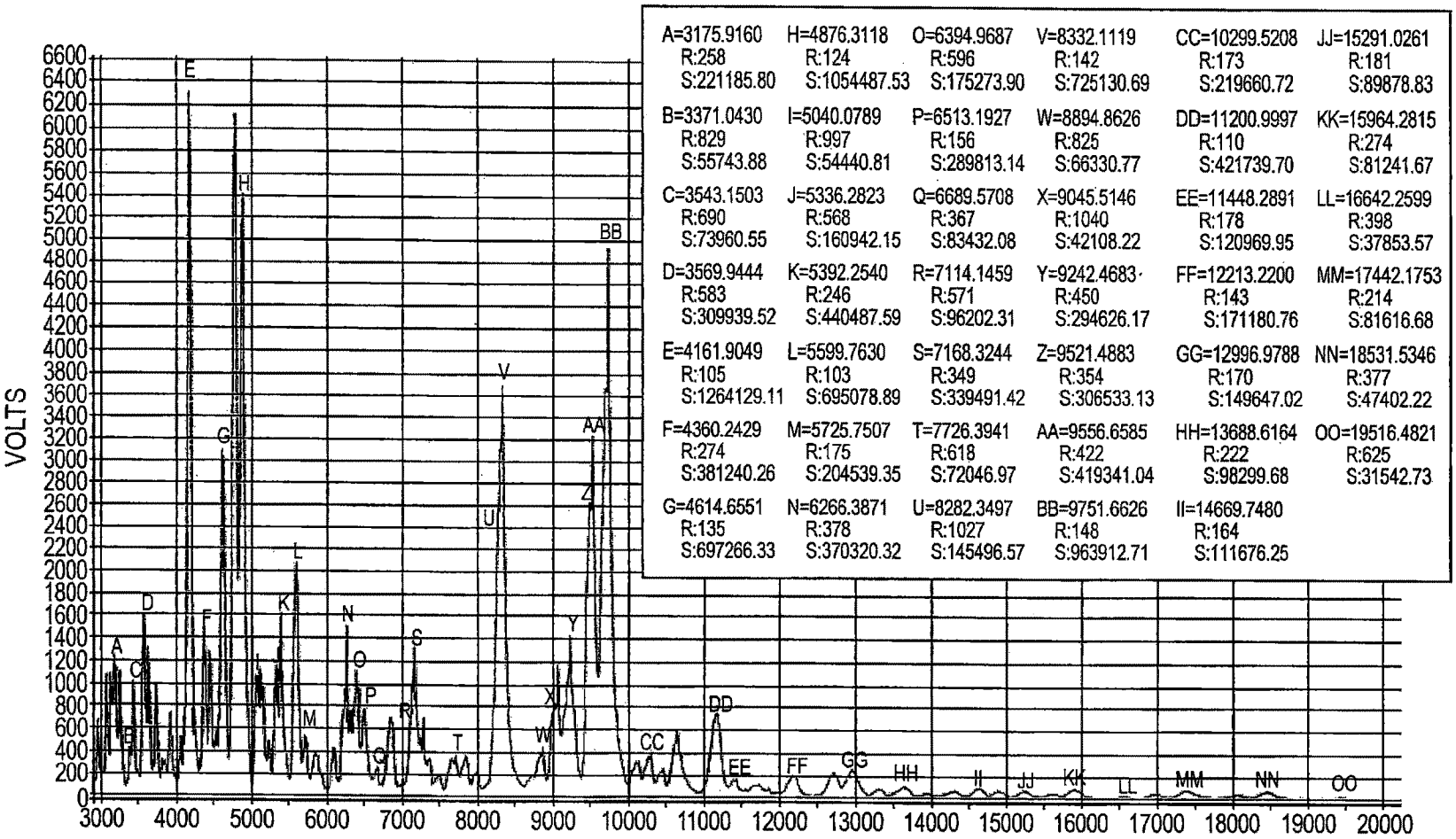
FIG. 24 is a mass spectrum generated by averaging mass spectra of 48 samples of ATCC 8739 *E. coli*. The 48 samples included three groups of 16 samples with extraction delay times of 200 ns, 800 ns and 1400 ns, respectively.

The spectra shown in FIGS. 21-23 were averaged together to generate the spectrum shown in FIG. 24. All previous spectra and the averaged spectrum were submitted to the bioMerieux proprietary in-vitro diagnostic (IVD) microorganism identification algorithm. The identification results are shown in Table 3. All spectra in Table 3 corresponds to mass spectra shown in FIGS. 13-20 and 24.

TABLE 3

Microorganism mass spectra for varied extraction delay times

| Extraction Delay Time [ns] | Identification Message | Species | Probability |
|---|---|---|---|
| 200 | No Identification | | |
| 500 | No Identification | | |
| 800 | Single Choice | *Esch. coli* | 99.99 |
| 1100 | Single Choice | *Esch. coli* | 100 |
| 1400 | No Identification | | |
| 1700 | No Identification | | |
| 2000 | No Identification | | |
| 2300 | No Identification | | |
| Average (200, 800, 1400) | Single Choice | *Esch. coli* | 99.99 |

The tested algorithm was only able to identify the spectra for 800 ns and 1,100 ns delay times, which are nearest to the theoretical desired extraction delay time of approximately 900 ns. However, when performing a simple average of the spectra corresponding to 200, 800, and 1,400 ns delay times, the algorithm was able to correctly identify the microorganism as *E. coli*. This indicates the potential usefulness of performing a variety of extraction delay time acquisitions for a single unknown sample to eliminate any dependence on the extraction delay time. By post-processing the spectra appropriately for such an acquisition, one could possibly eliminate the need to ensure that the extraction delay is suitably tuned prior to each acquisition. Additionally, more data is available to analyze in the mass regions corresponding to an increased resolution due to extraction delay time for research applications.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A delayed extraction (DE) time-of-flight mass spectrometer (TOF MS), comprising:

a housing;

an analysis flow path comprising a flight tube in the housing;

a laser coupled to the analysis flow path; and at least one detector in communication with the flight tube;

wherein the laser generates laser pulses with a plurality of different delay times during signal acquisition of a respective single sample, wherein one or more of the delay times of the plurality of different delay times is increased or decreased from another delay time in a range of about 1 nanosecond to about 500 nanoseconds, and wherein the at least one detector is configured to obtain spectra of the respective single sample associated with the different delay times to thereby obtain signal with a plurality of different focus masses at the at least one detector.

2. The DE-TOF MS of claim 1, further comprising a voltage source coupled to a voltage input, wherein the voltage input is coupled to the analysis flow path and provides a variable voltage input.

3. The DE-TOF MS of claim 1, wherein the flight tube has a length that is in a range of about 0.4 m and about 2 m.

4. The DE-TOF MS of claim 1, wherein the laser is a solid state laser and is one of an ultraviolet laser, an infrared laser, or a visible light laser.

5. The DE-TOF MS of claim 1, wherein the laser is an ultraviolet laser and is configured to transmit a laser beam with a wavelength in a range of about 320 nm and about 370 nm.

6. The DE-TOF MS of claim 1, further comprising a delayed extraction pulse generator in communication with a variable delay time module that cooperate to direct the DE-TOF MS to generate the laser pulses with the different delay times.

7. The DE-TOF MS of claim 6, wherein the variable delay time module is in communication with or integrated into a delayed extraction pulse generator and is configured to select a subsequent delay time or delay times for respective samples based on sample specific spectrums from a prior pass of a known delay time to thereby have an adaptive delay time capability.

8. The DE-TOF MS of claim 1, wherein the plurality of different delay times comprises between 2-10 different delay times in a range of 1 nanosecond and 2500 nanoseconds during a cumulative signal acquisition time of under 60 seconds for the respective sample.

9. The DE-TOF MS of claim 1, wherein the plurality of different delay times progressively increase or progressively decrease.

10. The DE-TOF MS of claim 1, wherein the DE-TOF MS is configured to detect focus masses in a range of about 2,000 and about 20,000 Dalton.

11. The DE-TOF MS of claim 1, wherein the laser is configured to input an ultraviolet laser beam with an energy in a range of about 1-10 microjoules measured at a target and a pulse width in a range of about 1-5 nanoseconds.

12. The DE-TOF MS of claim 1, further comprising an analysis module in communication with the at least one detector, wherein the analysis module is configured to generate at least one of a superimposed spectrum or a composite spectrum of m/z peaks from the obtained spectra.

13. The DE-TOF MS of claim 1, further comprising:

a variable delay time module in the housing that is configured to generate the plurality of different delay times; and a control circuit in the housing; and a digitizer in communication with the at least one detector, wherein the variable delay time module is incorporated at least partially into the control circuit or component of the control circuit, and wherein the variable delay time module is further configured to provide a trigger timing control for activating the digitizer.

14. A method of analyzing a respective sample, comprising:

providing a mass spectrometer with a flight tube;

transmitting laser pulses;

electronically and automatically varying delay times of the transmitted laser pulses thereby providing different delays between ionization and acceleration;

in response to the transmitted laser pulses with the varied delay times, acquiring signal of the respective sample with different focus masses at a detector of the mass spectrometer; and analyzing the acquired signal to identify if one or more microorganisms is present.

15. The method of claim 14, wherein the ionization is pulsed ionization.

16. The method of claim 14, wherein the varying delay times are either successively increased or successively decreased and each delay time is in a range of 1 nanosecond and 2500 nanoseconds, and wherein the varying delay times are between 2-10 different delay times for the respective sample.

17. The method of claim 14, wherein a cumulative signal acquisition time of the acquired signal of the respective sample is less than 60 seconds.

18. The method of claim 14, wherein the transmitted laser pulses is carried out before varying the varying delay times by:

obtaining a first baseline pass of the respective sample at a first delay time;

determining if peaks of interest reside outside a predetermined range on either side of a focus mass of the first baseline pass; and selecting subsequent delay times for the electronically and automatically varying delay times based on if peaks of interest reside outside the predetermined range.

19. The method of claim 14, further comprising switching ionization events on and off and controlling initiation of acceleration to generate the varying delay times, and wherein at least some successive delay times of the varying delay times change between about 10 nanoseconds to about 500 nanoseconds.

20. The method of claim 14, wherein the analyzing is carried out to identify whether constituents of the one or more microorganisms are present in a mass range of about 2,000 to about 20,000 Dalton.

* * * * *